US005547820A

United States Patent [19]

Miyamoto

[11] Patent Number: 5,547,820

[45] Date of Patent: Aug. 20, 1996

[54] SILVER HALIDE PHOTOGRAPHIC MATERIAL COMPRISING EMULSION LAYER AND BACKING LAYER PROVIDED ON SUPPORT

[75] Inventor: Hajime Miyamoto, Kanagawa, Japan

[73] Assignee: Fuji Photo Film Co., Ltd., Kanagawa, Japan

[21] Appl. No.: 362,925

[22] Filed: Dec. 23, 1994

[30] Foreign Application Priority Data

Dec. 24, 1993 [JP] Japan ..... 5-345871
Jan. 26, 1994 [JP] Japan ..... 6-007197

[51] Int. Cl.[6] ..... G03C 1/76

[52] U.S. Cl. ..... 430/523; 430/536; 430/537; 430/631; 430/961

[58] Field of Search ..... 430/523, 961, 430/631, 536, 537

[56] References Cited

U.S. PATENT DOCUMENTS 5,063,147 11/1991 Yoneyama et al. ..... 430/961
5,376,516 12/1994 Mochizaki et al. ..... 430/523
5,380,630 1/1995 Mochizaki et al. ..... 430/523

*Primary Examiner*—Geraldine Letscher
*Attorney, Agent, or Firm*—Sughrue, Mion, Zinn, Macpeak & Seas

[57] ABSTRACT

A silver halide photographic material comprises a silver halide emulsion layer and a surface backing layer provided on a support. The surface backing layer contains an aliphatic hydrocarbon compound represented by the formula (I) or (II)

$$C_{n1}H_{m1}—X^1—C_{n2}H_{m2} \quad (I)$$

$$C_{n3}H_{m3}—X^2—C_{n4}H_{m4}—X^3—C_{n5}H_{m5} \quad (II)$$

in which each of $X^1$, $X^2$ and $X^3$ is a divalent linking group selected from —CO—, —O—, —S—, —$NR^1$—, —SO—, —$SO_2$— and a combination thereof; $R^1$ is hydrogen or an aliphatic group having 1 to 8 carbon atoms; each of n1, n2, n3 and n5 is 4 to 100; each of m1, m2, m3 and m5 is 9 to 201; n4 is 3 to 100; m4 is 6 to 200; n1+n2 is 25 to 120; n3+n4+n5 is 30 to 150; at least one hydrogen atom of the groups $C_{n1}H_{m1}$—, —$C_{n2}H_{m2}$, $C_{n3}H_{m3}$—, —$C_{n4}H_{m4}$— and —$C_{n5}H_{m5}$ is substituted with a polar group selected from —OH, —$COOM^1$, —$NH_2$, —$N^+R^2R^3R^4R^5A^-$, —$CONH_2$ and —$SO_3M^2$; each of $R^2$, $R^3$, $R^4$ and $R^5$ is hydrogen or an aliphatic group having 1 to 8 carbon atoms; each of $M^1$ and $M^2$ is a cation; and A is an anion.

22 Claims, 1 Drawing Sheet

SILVER HALIDE PHOTOGRAPHIC MATERIAL COMPRISING EMULSION LAYER AND BACKING LAYER PROVIDED ON SUPPORT

FIELD OF THE INVENTION

The present invention relates to a silver halide photographic material. The invention more particularly relates to a silver halide photographic material comprising a silver halide emulsion layer and a surface backing layer provided on a support.

BACKGROUND OF THE INVENTION

A photographic material has a surface backing layer (scratch-protective backing layer, the lowermost layer) on a back face to improve slipperiness of the back face and to protect the face from scratch. The surface backing layer contains a slip agent. Examples of the conventional slip agents include polyorganosiloxane, higher fatty amides, higher fatty esters, higher fatty metal salts and polyester compounds made from lower dicarboxylic acids (having 2 to 10 carbon atoms) with aliphatic diols (including cyclic aliphatic diols). U.S. Pat. No. 4,275,146 discloses the higher fatty amides. U.S. Pat. Nos. 3,121,060 and 5,063,147, Japanese Patent Publication No. 58(1983)-33541, and Japanese Patent Provisional Publication Nos. 3(1991)- 153239 and 4(1992)-73743 disclose the higher fatty esters. U.S. Pat. No. 3,933,516 discloses the higher fatty metal salts. Japanese Pat. Provisional Publication No. 51(1976)-37217 discloses the polyester compounds.

The slip agents have a function of improving slipperiness of the back surface and an effect of protecting the surface from scratch. However, the conventional slip agents cause some problems in the photographic material.

For example, silicone compounds (such as polyorganosiloxane) may affect coating of an emulsion layer. The silicone compounds in a surface backing layer might be shifted to the other surface of the support, on which an emulsion layer is to be coated. The silicone compounds are repellent to the emulsion. Therefore, the sifted compounds disturb uniform coating of the emulsion. Further, compounds weaken adhesion between the support and the emulsion layer.

Higher fatty acids and derivatives thereof are free from the above-mentioned problems. However, the fatty acids and derivatives have another problem of bleeding. In more detail, the fatty acids and derivatives tend to be gradually deposited on the backing surface as white powder. Further, the fatty acids and derivatives tend to be dissolved or dispersed in processing solutions such as a developing solution to cause contamination in the solutions.

The above-mentioned problems may be solved by modifying the derivative moieties of the higher fatty acid derivatives. For example, polyhydric alcohol esters of higher fatty acids, higher alcohol esters of higher fatty acids, diester of higher fatty dicarboxylic acids or diols and oligoesters of higher fatty acids are effective for solving the problems.

SUMMARY OF THE INVENTION

The present inventor has studied slip agents, particularly higher fatty acid derivatives. As a result, the inventor notes a new problem of higher fatty acid derivatives. The inventor finds spotted patterns on a surface backing layer containing a higher fatty acid after a photographic material is processed with a developing solution. According to further study of the inventor, the patterns are caused by droplets of processing solutions. The higher fatty acid derivatives are repellent to the solutions. Accordingly, droplets of the solutions remain on the surface backing layer. The remaining droplets cause the patterns after drying the photographic material. This problem is serious when the photographic material is treated in a hanger processor. The patterns are visible in a printed photography or a projected image of a photographic slide.

The new problem cannot be solved by modifying the derivative moieties. Accordingly, a new slip agent should be developed to solve the problem.

An object of the present invention is to provide an improved silver halide photographic material, which is free from the problem of the spotted patterns while keeping the effects of a slip agent.

The present invention provides a silver halide photographic material comprising a silver halide emulsion layer and a surface backing layer provided on a support, wherein the surface backing layer contains an aliphatic hydrocarbon compound represented by the formula (I):

$$C_{n1}H_{m1}—X^1—C_{n2}H_{m2} \quad (I)$$

in which $X^1$ is a divalent linking group selected from the group consisting of —CO—, —O—, —S—, —$NR^1$—, —SO—, —$SO_2$— and a combination thereof; $R^1$ is hydrogen or an aliphatic group having 1 to 8 carbon atoms; each of n1 and n2 independently is an integer of 4 to 100; each of m1 and m2 independently is an integer of 9 to 201; n1+n2 is an integer of 25 to 120; at least one hydrogen atom of the groups $C_{n1}H_{m1}$— and —$C_{n2}H_{m2}$ is substituted with a polar group selected from the group consisting of —OH, —$COOM^1$, —$NH_2$, —$N^+R^2R^3R^4R^-$, —$CONH_2$ and —$SO_3M^2$; each of $R^2$, $R^3$, and $R^4$ independently is hydrogen or an aliphatic group having 1 to 8 carbon atoms; each of $M^1$ and $M^2$ is a cation; and A is an anion.

The invention further provides a silver halide photographic material comprising a silver halide emulsion layer and a surface backing layer provided on a support, wherein the surface backing layer contains an aliphatic hydrocarbon compound represented by the formula (II):

$$C_{n3}H_{m3}—X^2—C_{n4}H_{m4}—X^3—C_{n5}H_{m5} \quad (II)$$

in which each of $X^2$ and $X^3$ independently is a divalent linking group selected from the group consisting of —CO—, —O—, —S—, —$NR^1$—, —SO—, —$SO_2$— and a combination thereof; $R^1$ is hydrogen or an aliphatic group having 1 to 8 carbon atoms; each of n3 and n5 independently is an integer of 4 to 100; each of m3 and m5 independently is an integer of 9 to 201; n4 is an integer of 3 to 100; m4 is an integer of 6 to 200; n3+n4+n5 is an integer of 30 to 150; at least one hydrogen atom of the groups $C_{n3}H_{m3}$—, —$C_{n4}H_{m4}$— and —$C_{n5}H_{m5}$ the formula is substituted with a polar group selected from the group consisting of —OH, —$COOM^1$, —$NH_2$, —$N^+R^2R^3R^4R^-$, —$CONH_2$ and —$SO_3M^2$; each of $R^2$, $R^3$, and $R^4$ independently is hydrogen or an aliphatic group having 1 to 8 carbon atoms; each of $M^1$ and $M^2$ is a cation; and A is an anion.

The present inventor notes that the problem of the spotted patterns is solved by using the aliphatic hydrocarbon compound as a slip agent. Further, the aliphatic hydrocarbon compound excellently functions as the slip agent. Therefore, the silver halide photographic material of the present invention is free from the problem of the spotted patterns while keeping the excellent effects of the slip agent.

DETAILED DESCRIPTION OF THE INVENTION

Figure 1:
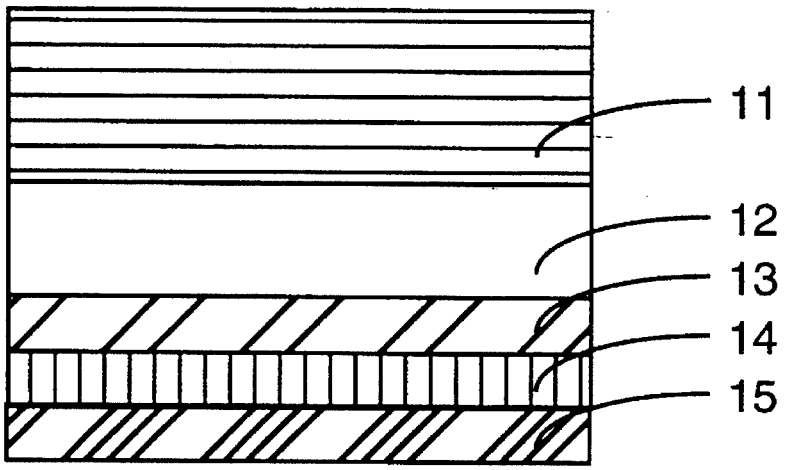
FIG. 1 is a sectional view schematically illustrating a preferred embodiment of the photographic material of the present invention.

The present invention is characterized by use of a specific aliphatic hydrocarbon compound as a slip agent. In the present specification, the aliphatic compound means a hydrocarbon compound having no aromatic group. The aliphatic hydrocarbon compound is represented by the formula (I) or (II).

$$C_{n1}H_{m1}—X^1—C_{n2}H_{m2} \quad (I)$$

In the formula (I), $X^1$ is a divalent linking group selected from —CO—, —O—, —S—, —$NR^1$—, —SO—, —$SO_2$— and a combination thereof. Examples of these combinations include —COO—, —$CONR^1$—, —$SO_3$—, —$OSO_3$—, —$SO_2NR^1$— and —$OCONR^1$—. $R^1$ is hydrogen or an aliphatic group having 1 to 8 (preferably 1 to 6 and more preferably 1 to 4) carbon atoms. The aliphatic group is an alkyl group, an alkenyl group or an alkynyl group, and preferably is an alkyl group. $X^1$ preferably is —COO— (ester) or —$CONR^1$— (amido).

In the formula (I), each of $C_{n1}H_{m1}$ and $C_{n2}H_{m2}$ means an aliphatic group. The aliphatic group is an alkyl group, an alkenyl group or an alkynyl group, and preferably is an alkyl group. The aliphatic group may have a straight, branched or cyclic chain structure. The straight chain structure is most preferred.

Each of n1 and n2 independently is an integer of 4 to 100, preferably of 10 to 70, and more preferably of 15 to 50 to obtain an effect of a slip agent sufficiently. Each of m1 and m2 independently is an integer of 9 to 201, preferably of 20 to 141, and most preferably of 30 to 101. The number of the total carbon atoms, namely n1+n2 is an integer of 25 to 120, preferably of 30 to 100, and more preferably of 40 to 80. If n1+n2 is more than 120, it is difficult to dissolve the compound in an organic solvent. If n1+n2 is less than 25, the compound does not sufficiently function as a slip agent.

At least one hydrogen atom in the formula (I) is substituted with a polar group selected from —OH, —$COOM^1$, —$NH_2$, —$N^+R^2R^3R^4R^-$, —$CONH_2$ and —$SO_3M^2$. Hydroxyl (—OH) is particularly preferred. Each of $R^2$, $R^3$, and $R^4$ independently is hydrogen or an aliphatic group having 1 to 8 carbon atoms (preferably 1 to 6 and more preferably 1 to 4) carbon atoms. The aliphatic group is an alkyl group, an alkenyl group or an alkynyl group, and preferably is an alkyl group. Each of $M^1$ and $M^2$ is a cation. Examples of the cations include proton, an alkali metal ion, an alkaline earth metal ion and a quarternary ammonium ion. A is an anion. An example of the anion is a halide ion. Two or more hydrogen atoms in the formula (I) may be substituted with the polar group.

$$C_{n3}H_{m3}—X^2—C_{n4}H_{m4}—X^3—C_{n5}H_{m5} \quad (II)$$

In the formula (II), each of $X^2$ and $X^3$ independently is a divalent linking group selected from —CO—, —O—, —S—, —$NR^1$—, —SO—, —$SO_2$— and a combination thereof. Examples of the combinations include —COO—, —$CONR^1$—, —$SO_3$—, —$OSO_3$—, —$SO_2NR^1$— and —$OCONR^1$—. $R^1$ is hydrogen or an aliphatic group having 1 to 8 (preferably 1 to 6 and more preferably 1 to 4) carbon atoms. The aliphatic group is an alkyl group, an alkenyl group or an alkynyl group, and preferably is an alkyl group. Each of $X^2$ and $X^3$ preferably is —COO— (ester) or —$CONR^1$— (amido) .

In the formula (II), each of $C_{n3}H_{m3}$ and $C_{n5}H_{m5}$ means an aliphatic group. The aliphatic group is an alkyl group, an alkenyl group or an alkynyl group, and preferably is an alkyl group. The aliphatic group may have a straight, branched or cyclic chain structure. The straight chain structure is most preferred.

In the formula (II), $C_{n4}H_{m4}$ means a divalent aliphatic group. The divalent aliphatic group is an alkylene group, an alkenylene group or an alkynylene group, and preferably is an alkylene group. The divalent aliphatic group may have a straight, branched or cyclic structure. The straight structure is most preferred.

Each of n3 and n5 independently is an integer of 4 to 100, preferably of 10 to 70, and more preferably of 15 to 50 to obtain an effect of a slip agent sufficiently. Each of m3 and m5 independently is an integer of 9 to 201, preferably of 20 to 141, and most preferably of 30 to 101. Further, n4 is an integer of 3 to 100, preferably of 5 to 50, more preferably of 10 to 30, and most preferably of 12 to 25. Furthermore, m4 is an integer of 6 to 200, preferably of 10 to 100, more preferably of 20 to 60, and most preferably of 24 to 50. The number of the total carbon atoms, namely n3+n4+n5 is an integer of 30 to 150, preferably of 40 to 130, and more preferably of 50 to 120. If n3+n4+n5 is more than 150, it is difficult to dissolve the compound in an organic solvent. If n1+n2 is less than 30, the compound does not sufficiently function as a slip agent.

At least one hydrogen atom in the formula (II) is substituted with a polar group selected from —OH, —$COOM^1$, —$NH_2$, —$N^+R^2R^3R^4R^-$—, —$CONH_2$ and —$SO_3M^2$. Hydroxyl (—OH) is particularly preferred. Each of $R^2$, $R^3$, and $R^4$ independently is hydrogen or an aliphatic group having 1 to 8 carbon atoms (preferably 1 to 6 and more preferably 1 to 4) carbon atoms. The aliphatic group is an alkyl group, an alkenyl group or an alkynyl group, and preferably is an alkyl group. Each of $M^1$ and $M^2$ is a cation. Examples of the cations include proton, an alkali metal ion, an alkaline earth metal ion and a quarternary ammonium ion. A is an anion. An example of the anion is a halide ion. Two or more hydrogen atoms in the formula (II) may be substituted with the polar group.

Examples of the aliphatic hydrocarbon compounds are shown below.

$$C_{17}H_{33}-COO-(CH_2)_{25}-OH \quad (I\text{-}8)$$

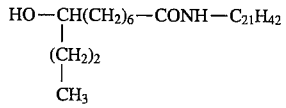

(I-9)

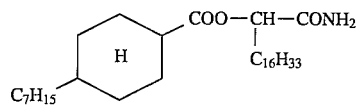

(I-10)

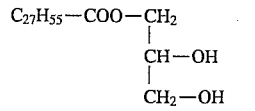

(I-11)

-continued $$HOOC-(CH_2)_5-COO-C_{40}H_{81} \quad (I\text{-}12)$$

$$NaO_3S-\underset{\underset{CH_3}{|}}{\underset{(CH_2)_{15}}{|}}CH-COO-CH_2\underset{C_{13}H_{27}}{\underset{|}{CH}}C_{10}H_{21} \quad (I\text{-}13)$$

$$HO-\underset{C_{14}H_{29}}{\underset{|}{CH}}-COO-(CH_2)_5-OCO-\underset{C_{14}H_{29}}{\underset{|}{CH}}-OH \quad (II\text{-}1)$$

$$C_{10}H_{21}-COO-\underset{C_2H_5}{\underset{|}{CH}}(CH_2)_7)\underset{C_2H_4-COOH}{\underset{|}{CH}}-OCO-C_{10}H_{21} \quad (II\text{-}2)$$

$$NaOOC-(CH_2)_{11}-COO-(CH_2)_{10}-OCO-(CH_2)_{11}-COOH \quad (II\text{-}3)$$

$$HO-\underset{C_9H_{19}}{\underset{|}{\overset{C_9H_{19}}{\overset{|}{C}}}}H_2-COO-(CH_2)_{15}-CONH-C_{10}H_{21} \quad (II\text{-}4)$$

$$H_2NOC-(CH_2)_{10}-COO-\underset{C_6H_{13}}{\underset{|}{CH}}(CH_2)_{10}-COO-C_{30}H_{61} \quad (II\text{-}5)$$

$$Cl^-(CH_3)_3{}^+N-\underset{C_{14}H_{29}}{\underset{|}{CH}}-COO-(CH_2)_{10}-OCO-C_{17}H_{33}. \quad (II\text{-}6)$$

$$HO-\underset{C_6H_{13}}{\underset{|}{CH}}(CH_2)_{10}-COO-(CH_2)_8-OCO-\underset{C_6H_{13}}{\underset{|}{\overset{CH-OH}{\overset{|}{(CH_2)_{10}}}}} \quad (II\text{-}7)$$

$$HO-\underset{C_6H_{13}}{\underset{|}{CH}}(CH_2)_{10}-COO-\underset{CH_3}{\underset{|}{CH}}-(CH_2)_7-\underset{CH_3}{\underset{|}{CH}}-OCO-C_{25}H_{51} \quad (II\text{-}8)$$

$$C_{15}H_{31}-COO-CH_2\underset{OH}{\underset{|}{CH}}CH_2-OCO-C_{15}H_{31} \quad (II\text{-}9)$$

$$C_8H_{17}-NHCO-(CH_2)_{10}-COO-(CH_2)_{15}-OH \quad (II\text{-}10)$$

$$C_{40}H_{81}-OCO-(CH_2)_{21}-COO-(CH_2)_5-COOH \quad (II\text{-}11)$$

$$NaO_3S-\underset{\underset{CH_3}{|}}{\underset{(CH_2)_{15}}{|}}CH-COO-(CH_2)_2\underset{CH_3}{\underset{|}{CH}}(CH_2)_2-OCO-C_{17}H_{35} \quad (II\text{-}12)$$

$$HO-(CH_2)_{17}-COO-(CH_2)_8\underset{C_2H_5}{\underset{|}{CH}}(CH_2)_9-COO-C_{50}H_{101} \quad (II\text{-}13)$$

Two or more aliphatic hydrocarbon compounds of the present invention can be used in combination.

The above-mentioned aliphatic hydrocarbon compounds comprise an aliphatic moiety having no polar group and other aliphatic moieties having a polar group. The non-polar moiety can be easily synthesized according to conventional methods, which are described in various documents such as Shigeyoshi Yamate et al., Chemistry of Fatty Acids (written in Japanese). The polar moiety can be obtained from a polyvalent carboxylic acid, a polyvalent alcohol, a polyvalent amine or a hydroxycarboxylic acid. The polar group of the compounds can be modified. Further, a polar group can be introduced into a double bond of an unsaturated aliphatic compound to form the polar moiety.

The above-mentioned moieties can be combined by an ester bond, an amido bond, an ether bond or a sulfo ester bond. In a reaction of forming the ester, a fatty acid and a fatty alcohol are melted or dissolved in a solvent. A catalytic reaction is caused in the resulting mixture or solution to form an ester. The reaction can proceed at an elevated temperature. The obtained ester is then refluxed at an elevated temperature. Water in the solvent is removed. Further, the solvent is removed by evaporation under reduced pressure. Furthermore, the ester was purified to remove the catalyst.

The aliphatic hydrocarbon compound is contained in a surface backing layer usually in an amount of 0.001 to 0.5 $g/m^2$, preferably in an amount of 0.001 to 0.1 $g/m^2$, more preferably in an amount of 0.005 to 0.05 $g/m^2$, and most preferably in an amount of 0.01 to 0.05 $g/m^2$.

The aliphatic hydrocarbon compound in the surface backing layer lowers the contact angle of a droplet of a treating solution on the surface backing layer. According to further study of the present inventor, the problem of the spotted pattern is particularly due to a final processing solution. A fixing bath usually is the final bath according to a conventional process of a color negative or color reversal photographic material. The solution of the fixing bath contains a hardening agent and a surface active agent. The solution usually contains poly(oxyethylene)nonylphenol (having about 9 polyethyleneoxide units) in an amount of about 0.1 to 0.5% as a nonionic surface active agent. Therefore, the problem of the spotted pattern directly relates to the contact angle of a droplet of the fixing solution on the surface backing layer. The contact angle is measured by the following method.

A developed sample is washed with flowing water for 2 minutes. The sample is dried, and conditioned at 25 ° C. and the relative humidity of 60% for 2 hours or more. A standard solution is used for measurement. The standard solution contains poly(oxyethylene)nonylphenol having 9 polyethyleneoxide units in the ,amount of 0.5%. The solution is dropped on a surface backing layer of the sample. After 2 minutes, the contact angle is measured at 25° C. and the relative humidity of 60%.

According to the present invention, the angle can be lowered to 45° or less. The spotted pattern is scarcely observed in a sample having an angle of 45° or less. The angle is preferably 40° or less.

In the case that a photographic material has an angle of 45° or more, the surface backing layer may contain a nonionic surface active agent or an anionic surface active agent besides the aliphatic compound of the present invention.

A preferred nonionic surface active agent is a polyoxyalkylene derivative represented by the formula (IIIa), (IIIb), (IIIc) or (IIId).

$$R^{21}-Y-(CH_2CH_2O)_a-R^{34} \quad (IIIa)$$

$$R^{22}-Y-(CH_2CHOHCH_2O)_b-R^{35} \quad (IIIb)$$

$$R^{23}-Y-((CH_2)_{c1}CHR^{32}CH_2O)_{c2}-R^{36} \quad (IIIc)$$

$$R^{24}-Y-(CH_2CH_2O)_{d1}-(CH_2CHOHCH_2O)_{d2}-((CH_2)_{d3}CHR^{33}CH_2O)_{d4}-R^{37} \quad (IIId)$$

In the formulas (IIIa) to (IIId), each of $R^{21}$, $R^{22}$, $R^{23}$ and $R^{24}$ is an aliphatic hydrocarbon group having 25 to 70 (preferably 30 to 60) carbon atoms. The aliphatic group preferably has a straight chain structure to obtain a function as a slip agent.

Y is a divalent linking group. Examples of the linking groups include —COO—, —OCO—, —$CONR^{25}$—, —$NR^{26}CO$—, —$SO_2NR^{27}$—, —$NR^{28}SO_2$—, —O—, —S—, —$NR^{29}$—, —$OCONR^{30}COO$— and —$OCONR^{31}O$—. Each of $R^{25}$, $R^{26}$, $R^{27}$, $R^{28}$ and $R^{29}$ is hydrogen or a hydrocarbon group having 1 to 8 carbon atoms. Each of $R^{30}$ and $R^{31}$ is a hydrocarbon group having 1 to 8 carbon atoms. An ester (—COO— or —OCO—) and an ether (—O—) are particularly preferred.

In the formulas, a is 3 to 40, b is 3 to 40, c1 is 1 to 3, c2 is 3 to 30, d1 is 0 to 40, d2 is 0 to 30, d3 is 0 to 30 and d1+d2+d3 is 3 to 40. Each of $R^{32}$ and $R^{33}$is hydrogen, methyl or phenyl.

If the alkylene oxide units are short, it is difficult to dissolve the nonionic surface active agent in a solvent. If the units are long, it is difficult obtain a function as a slip agent.

Each of $R^{34}$, $R^{35}$, $R^{36}$ and $R^{37}$ is hydrogen or methyl.

The formula (IIIa) is particularly preferred. In the formula (IIIa), a is preferably 5 to 30.

Examples of the nonionic surface active agents are shown below.

$C_{25}H_{15}-O-(CH_2CH_2O)_5-H$ (III-1)

$C_{30}H_{61}-O-(CH_2CH_2O)_{10}-H$ (III-2)

$C_{30}H_{61}-O-(CH_2CH_2O)_{40}-H$ (III-3)

$C_{50}H_{101}-O-(CH_2CH_2O)_{40}-H$ (III-4)
(alkyl group distribution:$C_{30}$ to $C_{60}$)

$C_{70}H_{141}-O-(CH_2CH_2O)_{16}-H$ (III-5)
(alkyl group distribution:$C_{40}$ to $C_{70}$)

$C_{27}H_{55}-COO-(CH_2CH_2O)_6-H$ (III-6)

$C_{30}H_{61}-OCOCH_2CH_2COO-(CH_2CH_2O)_9-H$ (III-7)

$C_{40}H_{81}-OCOCH_2CH_2COO-(CH(CH_3)CH_2O)_8-H$ (III-8)

$C_{50}H_{101}-O-(CH_2CH_2O)_9-CH_3$ (III-9)

iso-$C_{40}H_{81}-O-(CH_2CH_2O)_{10}-H$ (II-10)

iso-$C_{40}H_{81}-O-(CH_2CH(OH)CH_2O)_{15}-H$ (III-11)

$C_{40}H_{81}-CH_2CH_2COO-(CH(CH_3)CH_2O)_6-(CH_2CH_2O)_8-H$ (III-12)

The polyoxyalkylene compound can be synthesized by an addition reaction of a higher alcohol with ethyleneoxide. The compound can also be synthesized by dehydration reaction of a dicarboxylic acid with a polyether adduct of a higher fatty acid. Further, the compound can be synthesized by a condensation reaction of a polyether adduct of a higher fatty acid with a higher fatty acid.

The nonionic surface active agent is preferably used as a dispersing agent for the aliphatic compound represented by the formula (I) or (II). The nonionic surface active agent can effectively disperse the aliphatic compound in an organic solvent. The nonionic surface active agent is effective to various conventional organic solvents. The slip effect of the aliphatic compound can be fully obtained in the case that the compound is finely and uniformly dispersed in the surface backing layer. Further, a binder can easily be added to the layer by using the nonionic surface active agent.

The ratio of the nonionic surface active agent to the aliphatic compound is preferably in the range of 1:9 to 9:1, and more preferably in the range of 6:4 to 2:8.

The nonionic surface active agent is contained in a surface backing layer preferably in an amount of 0.0005 to 0.5 g/m$^2$, more preferably in an amount of 0.002 to 0.01 g/m$^2$, and most preferably in an amount of 0.005 to 0.01 g/m$^2$.

A preferred anionic surface active agent is a sulfonic ester represented by the formula (IVa) or a sulfuric ester represented by the formula (IVb).

$R^{41}ZSO_3M^{43}$ (IVa)

$R^{42}ZOSO_3M^{44}$ (IVb)

In the formulas (IVa) and (IVb), each of $R^{41}$ and $R^{42}$ is an aromatic or aliphatic hydrocarbon group. Examples of the aromatic groups include phenyl and naphthyl. The aliphatic group may have a straight or branched chain structure. The aliphatic group may have an ester bond or a phosphoric ester bond in its chain structure. A straight chain alkyl group, an alkylphenyl group and an alkyl group having succinic ester bond are preferred. Each of $R^{41}$ and $R^{42}$ preferably contains 10 to 50 carbon atoms, and more preferably contains 12 to 40 carbon atoms.

Z is a divalent linking group. Examples of the linking groups include a single bond, —$R^{45}$—, —$OR^{46}$—, —$COOR^{47}$— and —$OCOR^{48}$—. Each of $R^{45}$, $R^{46}$, $R^{47}$ and $R^{48}$ is an alkyl group having 1 to 10 carbon atoms, a polyoxyethylene group and a polyoxypropylene group.

Each of $M^{43}$ and $M^{44}$ is a cation. Examples of the cations include proton, an alkali metal ion, an alkaline earth metal ion and a quarternary ammonium ion.

Examples of the anionic surface active agents are shown below.

$C_{12}H_{25}-OSO_3Na$ (IV-1)

$C_{16}H_{33}-OSO_3Na$ (IV-2)

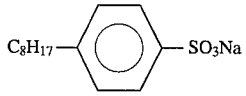
(IV-3)

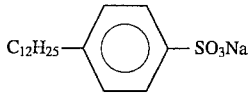
(IV-4)

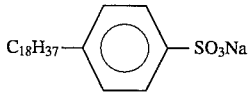
(IV-5)

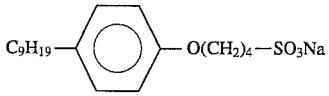
(IV-6)

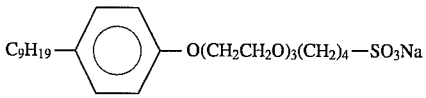
(IV-7)

n-$C_6H_{13}OCO-CH_2$
n-$C_6H_{13}OCO-CH-SO_3Na$ (IV-8)

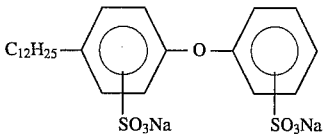
(IV-9)

$C_4H_9(C_2H_5)CHCH_2OCO-CH_2$
$C_4H_9(C_2H_5)CHCH_2OCO-CH-SO_3Na$ (IV-10)

-continued

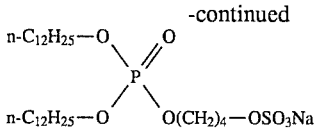

(IV-11)

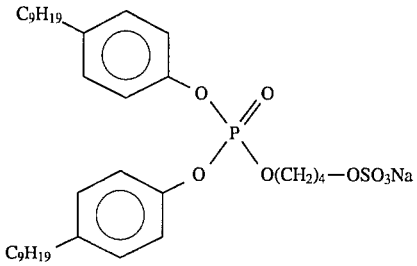

(IV-12)

The amount of the anionic surface active agent is preferably in the range of 0.001 g/m$^2$ to the amount of the aliphatic compound represented by the formula (I) or (II), and more preferably in the range of 0.005 g/m$^2$ to half the amount of the aliphatic compound.

The aliphatic compound and the surface active agents are contained the surface backing layer. The layer is formed by dissolving or dispersing the compounds in a solvent and coating and drying the solution or dispersion on a back face of a support. Water or an organic solvent is available as the solvent. A dispersion of the aliphatic compound can be added to a coating solution of the layer. The aliphatic compound is preferably in the form of particles, which are dispersed in a binder of the surface backing layer.

The aliphatic compound can be dispersed in water according to a conventional method. For example, the compound dissolved in an organic solvent can be emulsified in water. Further, the melted compound can be emulsified in water. Solid particles of the compound can be dispersed by a ball mill or a sand grinder. The emulsifying or dispersing methods are described in various technical documents. Water may contain a surface active agent The aliphatic compound can also be dispersed in an organic solvent according to a conventional method. For example, solid particles of the compound can be dispersed in an organic solvent using a ball mill or a sand grinder. Further, the compound dissolved in an organic solvent can be cooled while stirring to obtain a dispersion of the precipitated compound. Furthermore, the compound dissolved in an organic solvent can be added to cooled another solvent to obtain a dispersion of the precipitated compound. Moreover, an emulsion of the compound can be obtained by using two organic solvents that are not miscible with each other.

The method of adding the compound dissolved in an organic solvent to cooled another solvent is particularly preferred. The former solvent preferably dissolves the compound at a temperature in the range of 60° to 200° C., and more preferably in the range of 60° to 150° C. Examples of the solvents include hydrocarbons (e.g., hexane, decane, cyclohexane), high boiling point ketones (e.g., cyclohexanone, methyl isobutyl ketone), high boiling point esters (e.g., butyl acetate, amyl acetate) and high boiling point alcohols (e.g., 1-butanol, propylene glycol monomethylether, diacetone alcohol). The resulting solution preferably contains the slip agent in an amount of 1 to 70 wt. %, more preferably 3 to 50 wt. %, and most preferably 5 to 30 wt. %.

Examples of the cooling solvents include aromatic hydrocarbons, ethers, ketones, esters, alcohols and phenols. Ketones and alcohols are preferred. The solubility of the slip agent in the cooling solvent is preferably not higher than 0.05% at 25° C. After the precipitation, the slip agent is preferably contained in the dispersion in an amount of 0.1 to 40 wt. %, more preferably 0.5 to 30 wt. %, and most preferably 1 to 20%.

In the above-mentioned dispersing process, the non-ionic surface active agent represented by the formula (III) can function as a dispersing agent for the slip agent.

A conventional dispersing machine, a high speed homogenizer, an ultrasonic dispersing machine and a high pressure homogenizer are available for dispersing the aliphatic compound in the organic solvent. An ultrasonic dispersing machine and a high pressure homogenizer are preferred. The dispersing machines are available at any stages of the preparation of the dispersion.

After the preparation of the dispersion, the slip agent preferably has a particle size of not more than 1 μm, more preferably of not more than 0.7 μm, and most preferably of not more than 0.5 μm.

Examples of the organic solvents used for the other addition methods include alcohols (e.g., methanol, ethanol, isopropanol, butanol), ketones (e.g., acetone, methylethylketone, cyclohexanone), esters (e.g., methyl, ethyl, propyl or butyl ester of acetate, formate, oxalate, maleate or succinate), aliphatic hydrocarbons (e.g., hexane, cyclohexane), halogenated hydrocarbons (e.g., methylene chloride, chloroform, carbon tetrachloride), aromatic hydrocarbons (e.g., benzene, toluene, xylene, benzyl alcohol, benzoic acid, anisole), amides (e.g., dimethylformamide, dimethylacetamide, n-methylpyrrolidone), ethers (e.g., diethyl ether, dioxane, tetrahydrofuran), ether alcohols (e.g., propylene glycol monomethyl ether), glycerin, diethylene glycol and dimethylsulfoxide.

The surface backing layer preferably further contains a polymer as a binder. Various known polymers are available as the binder. The polymers include thermoplastic resins, thermosetting resins, radiation setting resins, reaction setting resins, mixtures thereof and hydrophilic binders. The amount of the binder in the surface backing layer is preferably in the range of 0.01 to 0.5 g/m$^2$, and more preferably in the range of 0.015 to 0.01 g/m$^2$.

Examples of the thermoplastic resins include cellulose derivatives (e.g., cellulose triacetate, cellulose diacetate, cellulose acetate maleate, cellulose acetate phthalate, hydroxyacetyl cellulose phthalate, a higher alkyl ester of cellulose, nitrocellulose, cellulose acetate propionate, cellulose acetate butyrate), vinyl copolymers (e.g., vinyl chloride-vinyl acetate copolymer, a copolymer of vinyl chloride or vinyl acetate with vinyl alcohol, maleic acid or acrylic acid, vinyl chloride-vinylidene chloride copolymer, vinyl chloride-acrylonitrile copolymer, ethylene-vinyl acetate copolymer), acrylic resins, polyvinyl acetal resins, polyvinyl butyral resins, polyester polyurethane resins, polyether polyurethane resins, polycarbonate polyurethane resins, polyester resins, polyether resins, polyamide resins, amino resins, styrene-butadiene resins, butadiene-acrylonitrile resins, silicone resins and fluorine resins.

The radiation setting resins are formed by introducing a radiation setting functional group into the above-mentioned thermoplastic resins. The functional group has an unsaturated carbon to carbon bond. Examples of the functional groups include acryloyl and methacryloyl.

A polar group may be introduced into the above-mentioned polymers. Examples of the polar groups include epoxy, —COOM, —OH, —$NR_2$, —$NR_3X$, —$SO_3M$, —$PO_3M_2$ and —$OPO_3M_2$. M is a cation such as proton, an alkali metal atom and ammonium. Two or more cations may be different from each other. R is hydrogen or an alkyl group. Two or more alkyl groups may be different from each other.

Two or more polymers may be used in combination. A hardening agent can be used with the polymer. The hardening agents include an isocyanate cross-linking agent and a radiation setting vinyl monomer.

The hydrophilic polymers include water-soluble polymers, cellulose esters and latex polymers, which are disclosed in Research Disclosure No. 17643, page 26 and No. 18716, page 651. Examples of the water-soluble polymers include gelatin, gelatin derivatives, casein, agar, sodium alginate, polyacrylic copolymers and maleic anhydride copolymers. Examples of the cellulose esters include carboxymethyl cellulose and hydroxymethyl cellulose. Examples of the latex polymers include vinyl chloride copolymers, vinylidene anhydride copolymers, acrylic ester copolymers, vinyl acetate copolymers and butadiene copolymers. Gelatin is most preferred. Gelatin can be used in combination with another polymer such as a gelatin derivative.

The surface backing layer may further contain a hardening agent for the hydrophilic polymer. Examples of the hardening agents include aldehydes (e.g., formaldehyde, glutaraldehyde), ketones (e.g., diacetyl, cyclopentadione), active halogen compounds (e.g., bis(2-chloroethylurea), 2-hydroxy-4,6-dichloro-1,3,5-triazine), active olefin compounds (e.g., divinylsulfone, 5-acetyl-1,3-diacryloylhexahydro-1,3,5-triazine), N-hydroxymethylphthalimide, N-methylol compounds, isocyanates, aziridines, acid derivatives, epoxy compounds and halogenated carboxyaldehydes (e.g., mucochloric acid). Inorganic hardening agents such as chromium alum and zirconium sulfate are also available. An active carboxyl hardening agent is further available.

A polar group is preferably introduced into the above-mentioned hydrophilic polymers. Examples of the polar groups include —OH, —COOM, —$NR_3^+$, —$CONH_2$, —SH, —$OSO_3M$ and —$OSO_3M$. M is a cation such as proton, an alkali metal atom and ammonium. R is hydrogen or an alkyl group. Two or more alkyl groups may be different from each other. Preferred examples of the hydrophilic polymers having the polar groups include cellulose triacetate, cellulose diacetate, cellulose acetate, cellulose maleate, cellulose acetate phthalate, hydroxyacetyl cellulose phthalate, a higher alkyl ester of cellulose, nitrocellulose, cellulose acetate propionate and cellulose acetate butyrate. Cellulose diacetate is particularly preferred.

The layered structure of the photographic material of the invention is described below referring to the drawings.

FIG. 1 is a sectional view schematically illustrating a preferred embodiment of the photographic material of the invention.

As is shown in FIG. 1, silver halide emulsion layers (11) are provided on a support (12). An antistatic backing layer (13) containing antistatic agents is provided on the back face of the support (12). A protective backing layer (14) containing matting agents is furthermore provided on the antistatic backing layer (13). The surface backing layer of the present invention (15) containing a specific aliphatic compound as a slip agent is provided on the protective backing layer (14). This embodiment is further described in Example 1 of the present specification.

Figure 2:
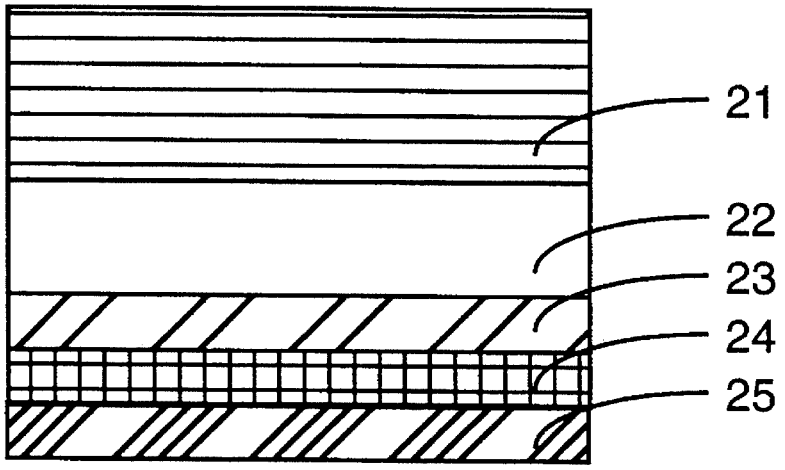
FIG. 2 is a sectional view schematically illustrating another preferred embodiment of the photographic material of the present invention.

FIG. 2 is a sectional view schematically illustrating another preferred embodiment of the photographic material of the invention.

As is shown in FIG. 2, silver halide emulsion layers (21) are provided on a support (22). An antistatic backing layer (23) containing antistatic agents is provided on the back face of the support (22). An adhesive layer (24) made from a radiation setting resin and an isocyanate compound is furthermore provided on the antistatic backing layer (23). The surface backing layer of the present invention (25) containing a specific aliphatic compound as a slip agent is provided on the adhesive layer (24). This embodiment is further described in Example 5 of the specification.

As is described above, various backing layers can be provided between the surface backing layer and the support. The components of the backing layers are described below.

An antistatic agent is usually contained in an antistatic backing layer.

Anionic polymer electrolytes and cationic polymer electrolytes are available as the antistatic agent. Examples of the cationic electrolytes include carboxylic acid, carboxylic salt and sulfonic salts. The anionic polymer electrolytes are described in Japanese Patent Publication No. 46(1971)-24159, Japanese Patent Provisional Publication Nos. 48(1973)-22017, 51(1976)-30725, 51(1976)- 129216 and 55(1980)-95942. The cationic polymer electrolytes are described in Japanese Patent Publication No. 49(1974)-24582, Japanese Patent Provisional Publication Nos. 48(1973)-91165 and 49(1974)-121523.

Further, crystalline metal oxides and complex particles of metal oxides are preferably used. The metal oxides keep the conductivity after a development process. Examples of the metal oxides include ZnO, $TiO_3$, $SnO_2$, $Al_2O_3$, $In_2O_3$, $SiO_2$, MgO, BaO, $MoO_3$ and $V_2O_5$. A conductive material substantially containing $SnO_2$ is particularly preferred. The material may further contain the other substances such as antimony oxide, silicon oxide, boron and phosphor. The material preferably further contains antimony oxide in an amount of 5 to 20%. The crystalline oxides and complex particles have a volume resistance of not more than $10^7$ Ω·cm, and preferably of not more than $10^5$ Ω·cm. The primary particle size is preferably in the range of 0.001 to 0.2 μm, and more preferably in the range of 0.002 to 0.05 μm. The primary particles are aggregated to form secondary particles. The secondary particle size is preferably in the range of 0.002 to 0.7 μm, and more preferably in the range of 0.005 to 0.3 μm.

The antistatic agent may be contained in the other layers, such as an undercoating backing layer, another backing layer (including the surface backing layer of the present invention), the undercoating layer for emulsion layers, an emulsion layer, an intermediate layer and the uppermost surface layer.

The binder of the antistatic agent may be soluble in water or an organic solvent. A cross-linked polymer may also be used as a binder in the form of a latex.

The antistatic layer preferably has a resistance of not more than $10^{12}$Ω, and preferably of not more than $10^{10}$Ω.

A matting agent is usually contained in a protective backing layer. The matting agent has a function of protecting a photographic material from deviation and scratch, which are caused while handling the support. The agent has another function of reducing adhesion between the undercoating surface of the support and the backing surface or between the emulsion surface and the backing surface. Inorganic compounds and polymers are available as the matting agent. The polymer preferably has a glass transition point (Tg) of not lower than 50° C. Two or more matting agents may be used in combination.

Examples of the inorganic matting agents include barium sulfate, colloidal manganese, titanium dioxide, strontium barium sulfate and silicon dioxide. The silicon dioxide can be synthesized according to a wet method or by gelation of silicic acid. The titanium dioxide (anatase structure or futile structure) can be synthesized from titanium slag and sulfuric acid. Relatively large inorganic particles (for example, 20 μm or more) can be crashed and separated (by vibrating filtration or pneumatic separation) to obtain a matting agent.

Examples of the polymer matting agents include polytetrafluoroethylene, cellulose acetate, polystyrene, polymethyl methacrylate, polypropyl methacrylate, polymethyl acrylate, polyethylene carbonate and starch. The polymer matting agent can be obtained by separation. The matting agent can also be synthesized from a monomer. Polymer particles can be formed according to a suspension polymerization method, a spray drying method or a dispersing method. Examples of the monomers include acrylic esters, methacrylic esters, itaconic diesters, crotonic esters, maleic diesters, phthalic diesters, styrene derivatives, vinyl esters, acrylamides, vinyl ethers, allyl compounds, vinyl ketones, vinyl heterocyclic compounds, acrylonitrile, methacrylonitrile and polyfunctional monomers. Two or more monomers can be used in combination.

The matting agents have an average particle size preferably in the range of $10^{-3}$ to $10^{2}$ μm, more preferably in the range of $10^{-1}$ to 10 μm, and most preferably in the range of 0.5 to 5 μm. The amount of the matting agent is preferably in the range of 0.1 to $10^{3}$ mg/m$^2$, more preferably in the range of 5 to 100 mg/m$^2$, and most preferably in the range of 20 to 250 mg/m$^2$.

A binder is preferably used for the matting agent. Examples of the binders are the same as those described as the binders for the surface backing layer. The matting agent may be contained in the surface backing layer besides the protective backing layer.

An adhesive layer may be provided between the surface backing layer and the support. The adhesive layer is preferably made from a radiation setting resin and an isocyanate compound.

The radiation setting resin is a monomer, an oligomer or a polymer that can be cross-linked with radiation. The resin has at least one reactive group such as acryloyl, methacryloyl, allyl and vinyl.

The resin is preferably made from a urethane acrylate. The urethane acrylate may be in the form of an oligomer or a polymer. A mixture of a monomer, an oligomer or a polymer is also available. The urethane acrylate forms a cross-link under radiation. The urethane acrylate is preferably formed by reacting diisocyanate with a polyol and further reacting the product with a compound represented by the following formula.

$$CH_2{=}C(X){-}R{-}Y$$

In the formula, R is a divalent linking group. Y is a group reactive with an isocyanate. Examples of the groups of Y include hydroxyl, amino and carboxyl. Hydroxyl is particularly preferred.

Examples of the diisocyanates include tolylene diisocyanate, 4,4-diphenylmethane diisocyanate, xylilene diisocyanate, hexamethylene diisocyanate, methylene bis(4-cyclohexylisocyanate), trimethylhexamethylene diisocyanate and isophorone diisocyanate. Aliphatic (including alicyclic) diisocyanates such as hexamethylene diisocyanate, methylene bis(4-cyclohexylisocyanate) and isophorone diisocyanate are preferred.

The polyol preferably has 2, 3 or 4 hydroxyl groups. Examples of the polyol compounds include butanediol, neopentyl glycol, ethoxyl bisphenol A, spiro-glycol of ethoxyl bisphenol S and pentaerythritol.

The compound represented by the above formula preferably is an acrylate or methacrylate having hydroxyl. Examples of the compounds include 2-hydroxyethyl acrylate, 2-hydroxymethacylate and pentaerythritol triacrylate.

Examples of the urethane acrylates are shown below.

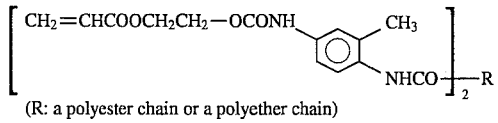
(V-1)

(R: a polyester chain or a polyether chain)

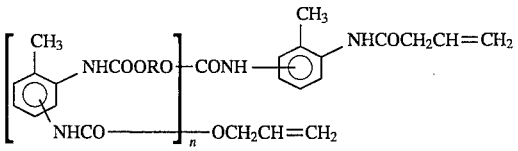
(V-2)

(R: a polyester chain or a polyether chain)

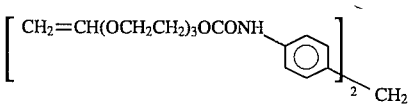
(V-3)

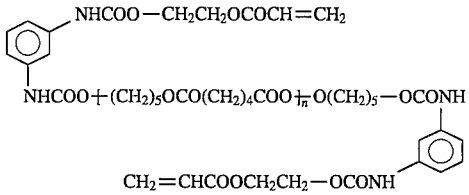
(V-4)

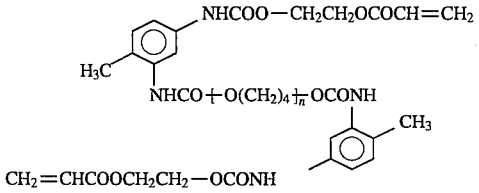
(V-5)

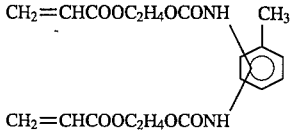
(V-6)

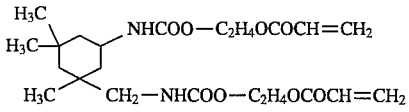
(V-7)

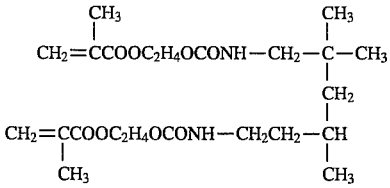
(V-8)

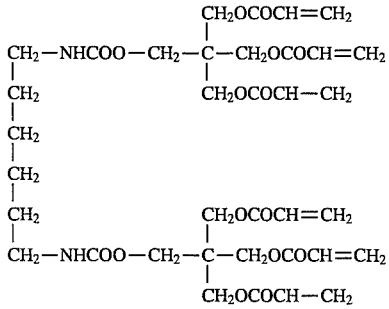
(V-9)

The resin is more preferably made from the above-mentioned urethane acrylate with a polyfunctional acrylate. The acrylate has at least three functional groups, and more preferably has 3 to 7 groups. Examples of the polyfunctional acrylates are shown below.
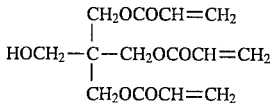
(VI-1)
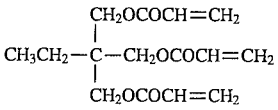
(VI-2)
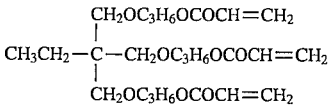
(VI-3)
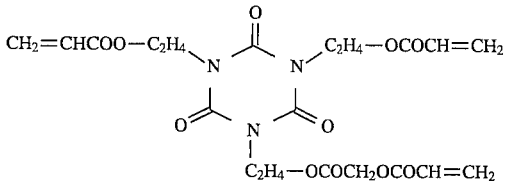
(VI-4)
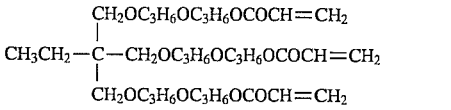
(VI-5)
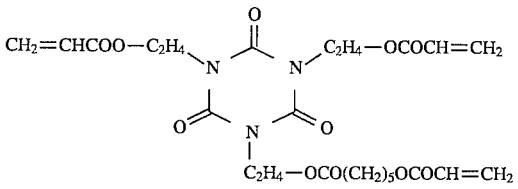
(VI-6)
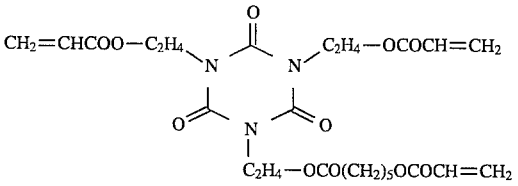
(VI-6)
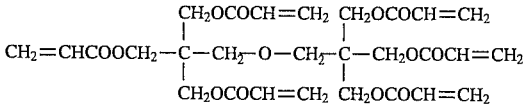
(VI-7)
An isocyanate compound is used as a cross-linking agent for the resin. The compound preferably has 2 to 6 isocyanate groups. Examples of the isocyanate compounds are shown below.
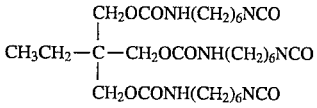
(VII-1)
-continued
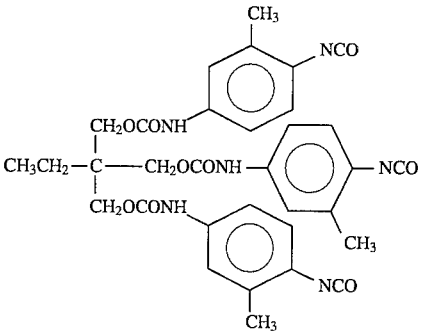
(VII-2)
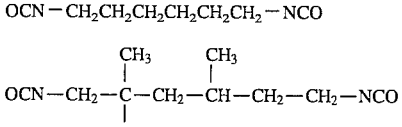
(VII-3)
(VII-4)
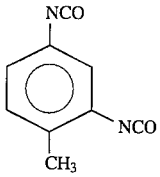
(VII-5)
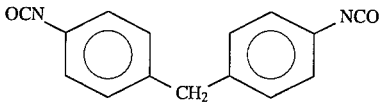
(VII-6)
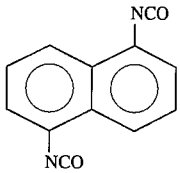
(VII-7)
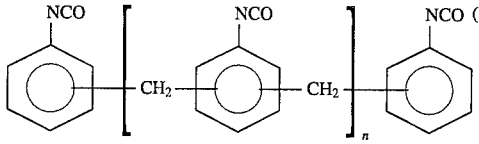
(VII-8)
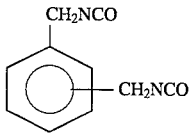
(VII-9)
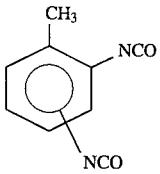
(VII-10)
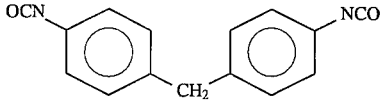
(VII-11)

-continued

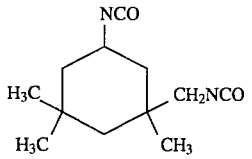

(VII-12)

A toluene diisocyanate such as the compound (VII-2) is particularly preferred.

A cross-linking accelerator can be used for the reaction of the resin with the isocyanate compound. A tertiary amine or a metal catalyst is available as the accelerator. Examples of the accelerators include 1,4-diazabicyclo(2,2,2)octane and dibutyltin dilaurate.

The radiation setting resin may further contain the other additives such as a viscosity adjusting agent. Examples of the adjusting agents include ethyl acrylate, 2-ethylhexyl acrylate and N-vinyl pyrrolidone. Further, a reaction initiator can be added to the resin for a setting reaction under ultraviolet radiation. Further, a coating solvent may be used for the formation of the adhesive layer.

The adhesive layer preferably contains the urethane acrylate in an amount of 5 to 90 wt. %, and more preferably of 40 to 90 wt. %. The layer preferably contains the polyfunctional acrylate in an amount of 60 to 5 wt. %, and more preferably of 90 to 10 wt. %. The layer preferably contains the isocyanate compound in an amount of 5 to 70 wt. %, and more preferably in an amount of 5 to 50 wt. %. The thickness of the adhesive layer is preferably in the range of 0.1 to 20 μm, and more preferably in the range of 1 to 10 μm.

The radiation setting resin can be hardened by irradiation of ultraviolet rays or electron rays. The irradiation can be conducted under the atmosphere, an inert gas or vacuum.

An intervening layer may be provided between the adhesive layer and the support. The intervening layer contains a polymer as a binder. Thermoplastic resins and thermosetting resins are available as the binder. Examples of the thermoplastic or thermosetting polymers include a polyester latex, a cellulose derivative and gelatin. The polymer preferably has an active hydrogen group to increase the adhesion to the adhesive layer. Further, the intervening layer preferably contains an isocyanate adhesive to increase the adhesion to the support. The intervening layer may contain conductive particles.

The above-mentioned backing layers (surface backing, antistatic backing, protective backing, adhesive and intervening layers) may further contain a dye or a surface active agent.

The support of the photographic material is described below.

Various plastic films are available as the support. Examples of the plastics include cellulose derivatives (e.g., diacetyl cellulose, triacetyl cellulose, propionyl cellulose, butanoyl cellulose, acetyl propionyl cellulose acetate), polyamides, polycarbonates, polyesters (e.g., polyethylene terephthalate, poly-1,4-cyclohexanedimethylene terephthalate, polyethylene 1,2-diphenoxyethane-4,4'-dicarboxylate, polybutylene terephthalate, polyethylene naphthalate), polystyrenes, polypropylenes, polyethylenes, polymethylpentenes, polysulfones, polyethersulfones, polyallylates and polyetherimides. The polycarbonates are described in U.S. Pat. No. 3,023,101. The polyesters are described in Japanese Patent Publication No. 48(1973)- 40414. Triacetyl cellulose, polyethylene terephthalate and polyethylene naphthalate are preferred.

The above-mentioned polymer of the support preferably has a molecular weight of not less than 10,000, and more preferably has a molecular weight in the range of 20,000 to 80,000.

The conventional 135 format uses the triacetyl cellulose film as a support. A polyester film such as polyethylene terephthalate film or polyethylene naphthalate film has a high mechanical strength (e.g., a high bending elasticity of the film). Therefore, the polyester film is advantageously used in the case that the frame number is increased in the patrone of the conventional 135 format. The polyester film is also advantageously used in a smaller patrone.

The conventional 135 format requires the minimum core diameter of 14 mm. In a smaller patrone, the minimum core (spool) diameter is in the range of 5 to 10 mm. Even if a polyester film is used as the support, the film would lose the elasticity to the winding in such a small patrone. The curled film causes a trouble while automatically carrying and developing the film. If the spool diameter is smaller than the lower limit, namely 5 mm, the photographic emulsion is fogged with the pressure.

The polyester film can be treated to prevent or reduce the curl. For example, Japanese Patent Provisional Publication No. 51(1976)-16358 discloses a process of heating a polyester film at a temperature of 30° to 5° C. below the glass transition point (Tg) of the film. Further, Japanese Patent Provisional Publication No. 1(1989)-131550 discloses a process of curling the film. The film is curled at a successive biaxially stretching process. In more detail, the front and back faces of the film are differentiated in crystalline and orientation by a temperature gradation between longitudinal and lateral stretching processes. The curled film is wound in a reverse direction to compensate the curling caused in the patrone. The film thermally treated at the stretching process can be further heated at a temperature 50° C. above the glass transition point.

The polyester film preferably has a high glass transition point for the above-mentioned thermal treatment. The glass transition point is preferably higher than 80° C., which is the most severe condition, namely the temperature of a patrone placed in a car under the summer sunshine. The transition point is more preferably in the range of 90° to 120° C. Accordingly, polyethylene naphthalate about 120° C.) is advantageously used in a small patrone.

A thermal treatment at a temperature of the glass transition point or above is conducted as a preheat treatment. On the other hand, a treatment at a temperature of 50° C. to the transition point is conducted as a post heat treatment. The post heat treatment includes a process of cooling film gradually to a temperature below the transition point.

The preheat treatment should destroy a crystalline structure of a polyester support completely. Accordingly, the temperature should be higher than the glass transition point. However, the film usually flows at a temperature 130° C. above the glass transition point. Further, the heating temperature is preferably lower than the crystalline temperature of the film. Therefore, the temperature is preferably adjusted in the range of Tg to Tg+130° C. The temperature more preferably is higher than Tg+10° C.

The preheat treatment is preferably conducted in the range of 0.1 minute to 1,500 hours, and more preferably in the range of 1 minute to 1 hour.

The post heat treatment is preferably conducted at a temperature in the range of 50° C. to Tg. The post heat treatment can be conducted at a constant temperature. Further, the film can be gradually cooled from the temperature of Tg. It is preferred to cool the film gradually from the temperature of the pretreatment.

In the process of gradually cooling the film, the cooling speed is preferably in the range of −0.01° to 20° C. per minute, and more preferably in the range of −0.01° to 5° C.

per minutes. The above-mentioned cooling speed is preferably employed between Tg to Tg–40° C.

The preheat or post heat treatment can be conducted by an infrared heater or a steam of high temperature.

The above-mentioned treatment can be conducted immediately after the formation of the film. Further, the treatment can be conducted at the process of drying an undercoating layer or a backing layer formed on the support.

For example, a polyester support is usually subjected to a thermal fixing process at the last stage of the film formation. The temperature of the fixing process is about 200° C. Accordingly, the above-mentioned treatment can be conveniently conducted after the fixing process. In more detail, the treatment can be conducted by cooling the film at about 200° C. to the temperature for the treatment by the air or a cooling drum, and passing the film through a zone having a temperature gradient for the treatment.

The treatment is more preferably conducted at the process of drying an undercoating layer or a backing layer formed on the support. The process requires a long drying zone. Accordingly, the drying zone is conveniently used for the treatment.

The support may contain a plasticizer. Particularly, a cellulose ester support usually contains triphenyl phosphate, biphenyldiphenyl phosphate or dimethylethyl phosphate as the plasticizer.

The polymer film support may further contain an ultraviolet absorbent. The ultraviolet absorbent preferably does not have absorption within visible regions. Examples of the ultraviolet absorbents include benzophenones (e.g., 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone, 2,2'-di-hydroxy- 4,4'-dimethoxybenzophenone), benzotriazoles (e.g., 2-(2'-hydroxy-5-methylphenyl)benzotriazole, 2-(2'-hydroxy-3',5'-di-t-butylphenyl)benzotriazole, 2-(2'-hydroxy-3'-di-t-butyl-5'-methylphenyl)benzotriazole) and salicylates (e.g., phenyl salicylate, methyl salicylate). The polymer film support contains the ultraviolet absorbent preferably in an amount of 0.5 to 20 wt. %, and more preferably in an amount of 1 to 10 wt. %.

The support may further contain a dye, which neutralizes the base color, or prevents light piping or halation.

A polyester support, particularly an aromatic polyester support has a relatively high refractive index of 1.6 to 1.7. On the other hand, the main component of the emulsion layers, namely gelatin has a refractive index of 1.50 to 1.55. Accordingly, light incident from the film edge reflects at the interface between the support and the emulsion layer. Therefore, a light piping development is caused.

The light piping development can be prevented by addition of a dye or inert inorganic particles to the support. The dye is preferred because the dye scarcely increases the film haze.

The hue of the dye is preferably gray. The dye should be resistant at the temperature for the film forming process. Further, the dye is preferably soluble in polyester.

Two or more dyes can be used in combination. The dyes are commercially available.

The support has a thickness preferably in the range of 20 μm to 1 mm, more preferably in the range of 50 to 300 μm, and most preferably in the range of 60 to 122 μm.

A gelatin undercoating layer is usually formed on a cellulose derivative support. Gelatin is dissolved in an organic solvent to form a coating solution of the undercoating layer. The organic solvent usually comprises methylene chloride, a ketone and an alcohol.

A polyester film support is usually subjected to corona discharge, irradiation with ultraviolet rays or glow discharge. The irradiation with ultraviolet rays and the glow discharge are particularly effective to the polyester film having a transition point of 90° to 200° C.

The corona discharge treatment is conducted at a discharge wavelength of 50 Hz to 5,000 kHz, and preferably of 5 kHz to 100 kHz. The strength of the discharge for a plastic film such as polyester and polyolefin is usually in the range of 0.001 KV·A·minute per $m^2$ to 5 KV·A·minute per $m^2$, and preferably in the range of 0.01 KV·A·minute per $m^2$ to 1 KV·A·minute per $m^2$. The gap clearance between the electrode and the dielectric roll is usually in the range of 0.5 to 2.5 mm, and preferably in the range of 1.0 to 2.0 mm.

The irradiation of ultraviolet rays can be conducted according to conventional methods, which are described in Japanese Patent Publication No. 45(1970)-3828.

The glow discharge treatment is conducted at a discharge wavelength of 0 (direct current) to several thousands MHz, preferably of 50 Hz to 200 MHz, and more preferably of 50 Hz to 1 MHz. The strength of the discharge is usually in the range of 0.01 KV·A·minute per $m^2$ to 5 KV·A·minute per $m^2$, and preferably in the range of 0.15 KV·A·minute per $m^2$ to 1 KV·A·minute per $m^2$.

The glow discharge treatment is preferably conducted in the presence of water vapor. The partial pressure of water vapor is preferably in the range of 10 to 100%, and more preferably in the range of 40 to 90%. Gas other than water vapor is the air containing nitrogen and oxygen. Water vapor is constantly introduced into the atmosphere for the glow discharge, while monitoring the composition of the gas.

A preheated support is preferably subjected to the glow discharge treatment. The preheat temperature is preferably in the range of 50° C. to the glass transition point of the film, and more preferably in the range of 90° C. to the transition point.

The preheat is conducted in vacuum for the glow discharge treatment. The support can be heated by an infrared heated or a heated roll in vacuum. For example, the support is placed on a heated roll at 115° C. for 1 second to conduct a preheat of 115° C.

The degree of vacuum and the voltage between electrodes should also be adjusted fro the glow discharge.

The pressure for the treatment is preferably in the range of 0.005 to 20 Torr, and more preferably in the range of 0.02 to 2 Torr.

The voltage is preferably in the range of 500 to 5,000 V, and more preferably in the range of 500 to 3,000.

Immediately after the glow discharge treatment, the support is preferably cooled by a cooling roll.

An undercoating layer is Usually provided on a polyester support. The undercoating layer may comprise two (first and second) layers. A single undercoating layer contains a resin having a hydrophilic group and hydrophobic group. The first undercoating layer is adhesive to the support, and the second under coating layer is adhesive to the emulsion layers.

The first undercoating layer contains a polymer as the binder. Examples of the polymers include polyvinyl chloride, polyvinylidene chloride, polybutadiene, polymethacrylic acid, polyacrylic acid, polyitaconic acid, polymaleic anhydride, a copolymer thereof, polyethyleneimine, an epoxy resin, graft polymer of gelatin and nitrocellulose.

The second undercoating layer mainly contains gelatin.

The single undercoating layer is provided after the surface of the support is swelled with an agent. The swelled support is then mixed with a hydrophilic polymer of the single undercoating layer to obtain strong adhesion. Examples of the hydrophilic polymers include gelatin, a gelatin derivative, casein, agar, sodium alginate, starch, polyvinyl alcohol, acrylic acid copolymer, maleic anhydride copolymer, cellulose esters (e.g., carboxymethyl cellulose, hydroxyethyl cellulose), vinyl chloride copolymer, vinylidene chloride copolymer and vinyl acetate copolymer. The polymers can be used in the form of an aqueous solution of a latex. Gelatin is most preferred.

Examples of the swelling agents include resorcinol, chlororesorcinol, o-cresol, m-cresol, p-cresol, phenol, o-chlorophenol, p-chlorophenol, dichlorophenol, trichlorophenol, chloroacetic acid, dichloroacetic acid, trifluoroacetic acid and hydrated chloral.

The hydrophilic undercoating layers may contain a hardening agent. Examples of the hardening agents are the same as those of the hardening agents for the hydrophilic backing layer.

The undercoating layers may further contain other additives such as a surface active agent, an antistatic agent, an antihalation dye, a pigment, a coating aid and an antifogging agent.

A matting agent may be contained in the undercoating layers. Inorganic particles and polymer particles are available as the matting agent. Examples of the inorganic particles include $SiO_2$ and $TiO_2$. An example of the polymer particle is made of polymethyl methacrylate copolymer. The particle size of the matting agent is preferably in the range of 1 to 10 μm.

The undercoating layer can be formed according to a conventional coating method, such as a dip coating method, an air knife coating method, a curtain coating method, a roller coating method, a wire bar coating method, a gravure coating method and an extrusion coating method. U.S. Pat. No. 2,681,294 discloses an extrusion coating method using a hopper. Two or more undercoating layers can be simultaneously coated on the support. The simultaneous coating method is described in U.S. Pat. Nos. 2,761,791, 2,941,898, 3,508,947 and 3,526,528.

A silver halide emulsion layer is preferably provided on the above-mentioned undercoating layer. A protective layer, an intermediate layer or an antihalation layer can also be provided on the undercoating layer. These layers are usually formed as hydrophilic colloidal layers.

The binder of the hydrophilic colloidal layer usually is gelatin or a gelatin derivative. The gelatins include a lime-treated gelatin, an acid-treated gelatin and an enzyme-treated gelatin.

The hydrophilic colloidal layers can contain a surface active agent.

A fluorine containing-(anionic, nonionic, cationic or betaine) surface active agent is available for the colloidal layers. The fluorine containing surface active agent is described in Japanese Patent Provisional Publication Nos. 49(1974)-10722, 50(1975)-113221, 53(1978)- 84712, 54(1979)-14224, 54(1979)-48520, 55(1980)-149938, 57(1982)-146248, 58(1983)-196544 and 58(1983)-200235, Japanese Patent Publication Nos. 52(1977)-26687, 57(1982)-26719 and 59(1984)-38573, U.S. Pat. Nos. 4,335,201 and 4,347,308, British Patent Nos. 1,330,356, 1,417,915 and 1,439,402.

The hydrophilic colloidal layers preferably contain a nonionic surface active agent. Examples of the nonionic surface active agents are shown below.

$$C_{11}H_{23}COO(CH_2CH_2O)_8H \quad \text{(VIII-1)}$$

-continued $$C_{17}H_{33}COO(CH_2CH_2)_5(CH_2\underset{\underset{OH}{|}}{C}HCH_3)_3(CH_2CH_2O)_5H \quad \text{(VIII-2)}$$

$$C_{16}H_{33}O(CH_2CH_2O)_{12}H \quad \text{(VIII-3)}$$

(VIII-4)

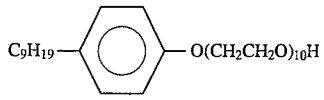

(VIII-5)

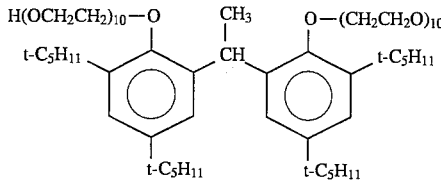

The above-mentioned fluorine containing or nonionic surface active agent can be contained in various layers, such as a surface protective layer, an emulsion layer, an intermediate layer, an undercoating layer and a backing layer.

The amount of the surface active agent is preferably in the range of 0.0001 to 1 g per 1 $m^2$, more preferably in the range of 0.0005 to 0.5 g per 1 $m^2$, and most preferably in the range of 0.0005 to 0.2 g per 1 $m^2$. Two or more surface active agents can be used in combination. The surface active agent functions as a coating aid. The surface active agent functions as an emulsifying or dispersing agent. The surface active agent has another function of improving a photographic property such as sensitivity.

A hydrophilic colloidal layer such as a protective layer may further contain a polyol compound. Examples of the polyol compounds include ethylene glycol, propylene glycol and 1,1,1-trimethylolpropane. The polyol compounds are disclosed in Japanese Patent Provisional Publication No. 54(1979)-89626.

A slip composition such as a modified silicone can be added to the hydrophilic colloidal layers. The slip compositions are described in U.S. Pat. Nos. 3,079,837, 3,080,317, 3,294,537, 3,545,970, 3,933,516 and 4,275,146, British Patent No. 927,446, Japanese Patent Provisional Publication Nos. 52(1977)-129520, 55(1980)-126238 and 58(1983)-90633. Japanese Patent Publication No. 58(1983)- 33541. The slip compositions can be used in combination with the slip agent of the present invention.

The hydrophilic colloidal layers may further contain a polymer latex, which is described in U.S. Pat. Nos. 3,411,911 and 3,411,912, Japanese Patent Publication No. 45(1970)-5331.

The hydrophilic colloidal layers such as a silver halide emulsion layer can be hardened by an organic or inorganic hardening agent. Two or more hardening agents can be used in combination.

The photographic material of the present invention is advantageously used as a color reversal film or a color negative film.

The shape of the silver halide grain may be either in the form of a regular crystal such as cube and octahedron or in the form of an irregular crystal such as globular shape and tabular shape. A grain having a defect of crystalline such as twined crystal is also available. The shape of the grain may be complex of these crystals.

The grain size of the silver halide is usually in the range of 0.2 to 10 μm. With respect to the grain size distribution, a monodispersed emulsion and a polydispersed emulsion are available.

A silver halide emulsion is usually subjected to a physical ripening, a chemical sensitization and a spectral sensitization. The chemical sensitization is preferably conducted by using a gold sensitizer and a sulfur sensitizer. The additives for the physical ripening, the chemical sensitization and the spectral sensitization are described in Research Disclosure Nos. 17643 and 18716.

The other additives for photographic materials are also described in Research Disclosure Nos. 17643 and 18716, as follows.

| Additives | No. 17643 | No. 17643 |
|---|---|---|
| Chemical sensitizers | Page 23 | Page 648, right column |
| Sensitivity increasing agent | | Page 648, right column |
| Spectral sensitizing dye and Supersensitizer | Pages 23 to 24 | Page 648, right column to page 649, right column |
| Breaching agent | Page 24 | |
| Antifogging agent and stabilizer | Page 24 to 25 | Page 649, right column |
| Light absorbing agent, filter dye and ultraviolet absorbent | Pages 25 to 26 | Page 650, right column |
| Stain inhibitor | Page 25, right column | Page 650 |
| Color image stabilizer | Page 25 | |
| Hardening agent | Page 26 | Page 651, right column |
| Binder | Page 26 | Page 651, right column |
| Plasticizer and slip agent | Page 27 | Page 650, right column |
| Coating aid and surface active agent | Pages 26 to 27 | Page 650, right column |

A formaldehyde scavenger can be contained in the photographic material. The scavenger traps formaldehyde gas, which degrades a photographic property of the material. The formaldehyde scavengers are described in U.S. Pat. Nos. 4,411,987 and 4,435,503.

The silver halide photographic material can contain various couplers. The couplers are described in Research Disclosure No. 17643, VII-C to G.

The couplers can be introduced into the photographic material according to various known dispersing methods.

A high-boiling solvent can be used in an oil in water dispersing method. The high-boiling solvents are described in U.S. Pat. No. 2,322,027.

The high-boiling organic solvents usually have a boiling point of not lower than 175° C. under a normal pressure. Examples of the high-boiling organic solvents include phthalic esters, phosphoric esters, phosphonic esters, benzoic esters, amides, alcohols, phenols, aliphatic carboxylic esters, aniline derivatives and hydrocarbons.

An organic solvent can be used as an auxiliary solvent in addition to the high-boiling organic solvent. The auxiliary solvent has a boiling point of not lower than 30° C. The boiling point preferably is in the range of 50° to 160° C. Examples of the auxiliary solvents include ethyl acetate, butyl acetate, ethyl propionate, methyl ethyl ketone, cyclohexanone, 2-ethoxyethyl acetate and dimethylformamide.

A latex dispersing method is available in preparation of the photographic material. The process of the latex dispersing method, effects thereof and examples of latex for impregnation are described in U.S. Pat. No. 4,199,363, German Patent Publications No. 2,541,274 and No. 2,541,230.

The total thickness of the hydrophilic colloidal layers is preferably not more than 28 μm.

The swelling rate ($T_{1/2}$) of the hydrophilic colloidal layer is preferably not more than 30 seconds. The swelling rate can be adjusted by adding a hardening agent to gelatin or changing the conditions after coating the layer.

The swelling ratio of the layer is preferably in the range of 150 to 400%. The swelling ratio means the ratio of (the maximum thickness of swelled layer minus the thickness of coated layer) to the thickness of coated layer.

The silver halide photographic material of the present invention can be developed according to a conventional method, which described in Research Disclosure Nos. 17643, pages 28 to 29 and 18716, page 615.

EXAMPLE 1

Formation of antistatic backing layer

On a cellulose triacetate (TAC) film having the thickness of 120 μm, the following coating solution was coated in the amount of 15 ml/m$^2$. The coated solution was dried at 70° C. for 3 minutes to form an antistatic backing layer. The layer contained the cationic polymer in the amount of 50 mg/m$^2$.

| Antistatic backing layer | |
|---|---|
| Cationic polymer shown below | 3.5 g |
| Ethylene glycol | 27 ml |
| Methanol | 600 ml |
| Acetone | 400 ml |

Cationic polymer

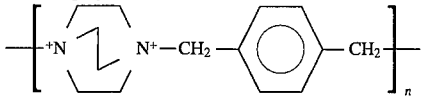

2Cl$^-$
(Viscosity: 0.12 $\eta_{sp/c}$)

The viscosity is determined by measuring 0.1 wt. % solution of the polymer in 1 wt. % aqueous solution of sodium chloride at 30° C.

Formation of protective backing layer

On the antistatic backing layer, the following coating solution was coated in the amount of 25 ml/m$^2$. The coated solution was dried at 100° C. for 3 minutes to form a protective backing layer.

| Protective backing layer | |
|---|---|
| Methylene chloride | 100 ml |
| Acetone | 750 ml |
| Methanol | 150 ml |
| Diacetyl cellulose | 6 g |
| $SiO_2$ fine particles (average particle size: 0.1 μm) | 0.7 g |

Formation of surface backing layer

The slip agents and the additives set forth in Table 1 were dissolved in xylene while heating. In the case that the agent or the additive was not dissolved at the room temperature, the mixture was heated to 50° C. to dissolve them in xylene. The solution was coated on the protective backing layer in the amount of the 10 ml/m$^2$. The solid coating amounts of the components are set forth in Table 1. The solution was dried at 110° C. for 3 minutes to prepare samples set forth in Table 1.

The above-mentioned procedures were conducted in an authomatic coating machine using a conveying case and a conveying roller at 115° C.

Formation of photographic emulsion layers

The reverse face of the support (on which the backing layers were not formed) was subjected to a discharge treatment. The following silver halide photographic emulsion layers for color photographic materials were coated on the treated surface of the support.

The layered structure of the color photographic material is shown below.

15. Second protective layer
14. First protective layer
13. Third blue sensitive emulsion layer
12. Second blue sensitive emulsion layer
11. First blue sensitive emulsion layer
10. Yellow filter layer
9. Third green sensitive emulsion layer
8. Second green sensitive emulsion layer
7. First green sensitive emulsion layer
6. Intermediate layer
5. Third red sensitive emulsion layer
4. Second red sensitive emulsion layer
3. First red sensitive emulsion layer
2. Intermediate layer
1. Antihalation layer
0. Support
B1. Antistatic backing layer
B2. Protective backing layer
B3. Surface backing layer Development of samples The samples were cut into a photographic film of 24 frames having the width of 35 mm according to the conventional 135 format.

The samples were developed as follows.

| Color development process | |
|---|---|
| Color development | 3 minutes and 15 seconds |
| Bleaching | 6 minutes and 30 seconds |
| Washing | 2 minutes and 10 seconds |
| Fixing | 4 minutes and 20 seconds |
| Washing | 3 minutes and 15 seconds |
| Stabilizing | 1 minute and 5 seconds |

The compositions for the processing solutions are shown below.

| Color developing solution | |
|---|---|
| Diethylenetriamine tetraacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 g |
| Sulfate salt of hydroxylamine | 2.4 g |
| 4-(N-ethyl-N-β-hydroxyethylamino)-2-methylaniline | 4.5 g |
| Water (make up to) | 1 liter |
| pH | 10.0 |
| **Bleaching solution** | |
| Ammonium salt of iron (III) ethylenediaminetetraacetate | 100.0 g |
| Disodium ethylenediaminetetraacetate | 10.0 g |
| Ammonium bromide | 150.0 g |
| Ammonium nitrate | 10.0 g |
| Water (make up to) | 1 liter |
| pH | 6.0 |
| **Fixing solution** | |
| Disodium ethylenediaminetetraacetate | 1.0 g |
| Sodium sulfite | 4.0 g |
| Aqueous solution (70%) of ammonium thiosulfate | 175.0 ml |
| Sodium bisulfite | 4.6 g |
| Water (make up to) | 1 liter |
| pH | 6.6 |

-continued

| Stabilizing solution | |
|---|---|
| Formalin (40%) | 2.0 ml |
| Polyoxyethylene-p-monononylphenylether (average polymerization degree: 9) | 0.3 g |
| Water (make up to) | 1 liter |

Evaluation of samples

The samples were evaluated as follows.

(1) Kinetic friction coefficient

The samples were conditioned at 25° C. and the relative humidity of 60% for 2 hours. The kinetic friction coefficient was measured in a machine (HEIDON-14) using stainless balls (diameter: 5 mm) under the charge of 100 g at the friction speed of 60 cm per minute. A small value means a high slipperiness.

(2) Resistance to scratch

The samples were conditioned at 25° C. and the relative humidity of 60% for 2 hours. Before the development process, a diamond needle (head: 0.025 mmR) was vertically applied to the backing surfaces of the samples. The samples were then scratched with the needle at the rate of 60 cm per minute continuously under a charge.

The samples were placed on an illuminating box. The samples were observed through a transparent light. The weight of the charge forming a visible scratch was evaluated as the resistance. A large value means a strong resistance.

(3) Coated surface

The coated surface was evaluated as five grades A to E. A means the best, B means good, C means tolerable, D means bad, and E means the worst.

(4) Repellent patterns

The samples were cut into the photographic films (width: 35 mm, length: 1.5 m). The films were developed in a hanger processor. In the processor, the films were hanged and dipped in the processing bathes. The repellent patterns formed on the back face of the samples were observed. The patterns were evaluated as three grades A to C. A means that patterns are scarcely observed. B means that patterns like liquid flow are observed. C means that various patterns are remarkably observed. The grades A and B are tolerable to a photographic material.

(5) Contact angle

The developed samples were washed with flowing water for 2 minutes, and dried. The samples were then conditioned at 25° C. and the relative humidity of 60% for 2 hours or more. The standard solution is 0.3% aqueous solution of poly(oxyethylene)nonylphenol (n=8.6). The measurement was conducted at 25° C. and the relative humidity of 60° C. A drop of the standard solution was added to the surface backing layer. After 2 minutes, the angle was measured The results are set forth in Table 1.

TABLE 1

| Samp. | Slip | Addi- | (1) | | (2) | | | | |
|---|---|---|---|---|---|---|---|---|---|
| No. | agent | tive | (B) | (A) | (B) | (A) | (3) | (4) | (5) |
| 1-1 | None | None | 0.45 | 0.43 | 15 | 15 | A | A | 20 |
| 1-2 | I-1 | None | 0.11 | 0.12 | 55 | 53 | B | B | 42 |
| 1-3 | I-4 | None | 0.12 | 0.11 | 58 | 54 | C | B | 44 |
| 1-4 | I-6 | None | 0.12 | 0.12 | 60 | 57 | C | B | 45 |
| 1-5 | I-10 | None | 0.12 | 0.13 | 51 | 57 | B | B | 42 |
| 1-6 | I-11 | None | 0.11 | 0.15 | 54 | 45 | B | B | 41 |
| 1-7 | I-13 | None | 0.12 | 0.14 | 50 | 42 | B | B | 43 |
| 1-8 | I-1 | III-2 | 0.11 | 0.12 | 55 | 52 | B | A | 40 |
| 1-9 | I-1 | IV-5 | 0.11 | 0.12 | 56 | 54 | B | A | 37 |

TABLE 1-continued

| Samp. No. | Slip agent | Additive | (1) (B) | (1) (A) | (2) (B) | (2) (A) | (3) | (4) | (5) |
|---|---|---|---|---|---|---|---|---|---|
| 1-10 | I-1 | IV-9 | 0.12 | 0.13 | 58 | 57 | B | A | 38 |
| 1-11 | II-1 | None | 0.12 | 0.12 | 56 | 60 | B | B | 40 |
| 1-12 | II-5 | None | 0.11 | 0.13 | 50 | 52 | B | B | 41 |
| 1-13 | II-10 | None | 0.12 | 0.14 | 53 | 45 | B | B | 42 |
| 1-14 | II-12 | None | 0.12 | 0.15 | 51 | 41 | B | B | 44 |
| 1-15 | II-1 | III-5 | 0.11 | 0.12 | 55 | 53 | B | A | 38 |
| 1-16 | II-1 | IV-2 | 0.12 | 0.12 | 57 | 53 | B | A | 39 |
| 1-17 | C-1 | None | 0.10 | 0.11 | 55 | 53 | B | C | 58 |
| 1-18 | C-2 | None | 0.12 | 0.12 | 53 | 54 | B | C | 54 |
| 1-19 | C-3 | None | 0.12 | 0.19 | 51 | 25 | B | C | 52 |
| 1-20 | C-4 | None | 0.11 | 0.22 | 50 | 20 | B | C | 47 |
| 1-21 | C-5 | None | 0.12 | 0.20 | 51 | 20 | B | B | 44 |
| 1-22 | C-6 | None | 0.13 | 0.23 | 52 | 23 | B | B | 43 |

(Remark)
(B) of (1) or (2): Value measured before development
(A) of (1) or (2): Value measured after development
Amount of slip agent: 15 g/m$^2$
Amount of III-2: 15 g/m$^2$
Amount of IV-5: 10 g/m$^2$
Amount of IV-9: 7.5 g/m$^2$
Amount of III-5: 10 g/m$^2$
Amount of IV-2: 10 g/m$^2$ Comparative slip agents (C-1) to (C-8) are shown below. In the experiments, the compounds (C-7) and (C-8) were not dissolved in the solvent (xylene) even though the mixture was heated. Accordingly, the samples containing these compounds were not prepared.

$C_{17}H_{35}COOC_{30}H_{61}$ C-1

$C_{18}H_{37}OCO(CH_2)_{10}COOC_{18}H_{37}$ C-2

$C_9H_{19}COOC_{10}H_{21}$ C-3

$C_4H_9OCO(CH_2)_{10}COOC_4H_9$ C-4

$C_9H_{18}COOCH_2CH(OH)CH_2OCOC_9H_{18}$ C-5

$C_{10}H_{21}OCO(CH_2)_{10}COOH$ C-6

$HOOC(CH_2)_{50}COOC_{70}H_{141}$ C-7

$C_{70}H_{141}OCO(CH_2)_8CH(CH_2)_8COOC_{70}H_{141}$ C-8

Preparation of film support

Polyethylene terephthalate (PET) tips or polyethylene naphthalate (PEN) tips were melted and extruded. The obtained films were stretched to the longitudinal direction of 3.4 times and to the lateral direction of 4 times. Thus, biaxially stretched polyester films were obtained. The thickness of the film was 80 μm.

In the above-process, the PET film was treated under conditions that the extrusion was conducted at 270° C., the longitudinal stretching was conducted at 100° C., the lateral stretching was conducted at 110° C., and a thermal fixing was conducted at 220° C. for 6 seconds.

The PEN film was treated under conditions that the extrusion was conducted at 300° C., the longitudinal stretching was conducted at 140° C., the lateral stretching was conducted at 130° C., and a thermal fixing was conducted at 250° C. for 6 seconds. At the longitudinal stretching, one face is further heated at 160° C.

Some PEN films were wound around a stainless core, and heated to at 110° C. for 72 hours.

Surface treatment

The two surfaces of the supports were irradiated with ultraviolet ray at a temperature of not higher than 115° C.

The following solution for the undercoating layer (a) was coated on the support in the amount of 10 cc/m$^2$. The coated solution was dried at 110° C. for 2 minutes. The supports were then wound up.

| Undercoating layer (a) | Weight part |
|---|---|
| Gelatin | 1 |
| Water | 1 |
| Acetic acid | 1 |
| Methanol | 50 |
| Ethylene dichloride | 50 |
| p-Chlorophenol | 4 |

Preparation of dispersion of conductive fine particles

In 3,000 weight parts of ethanol, 230 weight parts of tin(IV) chloride hydrate and 23 weight parts of antimony trichloride to form a uniform solution. To the solution, 1N aqueous sodium hydroxide solution was dropwise added to adjust pH of the solution to 3. Colloidal tin(IV) oxide and antimony oxide were precipitated. The precipitation was left at 50° C. for 24 hours. Thus, reddish brown colloidal precipitates were obtained.

The precipitates were separated by centrifugation. Water was added to the precipitates. The precipitates were washed with water by centrifugation to remove excess ions.

In 1,500 weight parts of water, 200 weight parts of precipitates were dispersed again. The dispersion was sprayed in a firing furnace to obtain bluish particles of tin(IV) oxide and antimony oxide. The primary particle size was 0.005 μm. The primary particles were aggregated to form a secondary particle, which has an average particle size of 0.15 μm. The resistance ratio of the fine particle was 25 Ω·cm.

With 60 weight parts of water, 40 weight parts of the particles were mixed. The mixture was adjusted to pH 7.0. The mixture was coarsely dispersed in a dispersing machine, and further dispersed for 30 minutes in a horizontal type sand mill (Dynomill, Willy A. Backfen AG).

Formation of antistatic backing layer

The following coating solution was coated on the back face (on which the undercoating layer was not provided) of the support. The solution was dried at 130° C. for 30 seconds to form an antistatic backing layer having the dry thickness of 0.3 μm.

| Antistatic backing layer | Weight part |
|---|---|
| Dispersion of conductive fine particles ($SnO_2/Sb_2O_3$, secondary particle size: 0.15 μm) | 10 |
| Gelatin | 1 |
| Water | 27 |
| Methanol | 60 |
| Resorcinol | 2 |
| Polyoxyethylene nonylphenylether (polymerization degree: 10) | 0.01 |

Formation of protective backing layer

The following components were dispersed in a sand grinder at 2,000 rpm for 2 hours using glass beads as dispersing medium. Toluenediisocyanate compound (amount: 30% to diacetyl cellulose) was added to the mixture. The resulting mixture was coated on the antistatic backing layer. The coating amount of the diacetyl cellulose was 0.3 g/m2. The coated solution was dried at 115° C. for 3 minutes.

The above-mentioned procedures were conducted in an authomatic coating machine using a conveying case and a conveying roller at 115° C.

| Protective backing layer | Weight part |
|---|---|
| Silicon dioxide (average particle size: 0.2 μm) | 0.01 |
| Aluminum oxide (average particle size: 0.4 μm) | 0.03 |
| Diacetyl cellulose (binder) | 1.0 |
| Methyl ethyl ketone | 9.4 |
| Cyclohexanone | 9.4 |
| Polyoxyethylene nonylphenylether (polymerization degree: 10) | 0.06 |
| Trimethylolpropane tritoluenediisocyanate | 0.03 |
| Colloidal silica (average particle size: 0.02 μm) | 0.02 |
| $C_8F_{17}SO_2N(CH_3)(CH_2CH_2O)_6H$ | 0.01 |
| Vinylidene difluoride-vinylidene tetrafluoride copolymer (molar ratio is 9:1) | 0.01 |
| Particles of methyl methacrylate-divinylbenzene copolymer (molar ratio is 9/1, average particle size: 1.0 μm) | 0.01 |

Formation of surface backing layer A

A surface backing layer A was formed on the protective backing layer in the same manner as in Example 1, except that the slip agent and the additive set forth in Table 2 were used.

Formation of surface backing layer B

In 4 weight parts of xylene (solvent), 1 weight part of the mixture of the slip agent and the additive set forth in Table 2 was dissolved at 105° C.

The solution was added to 15 weight parts of isopropanol. The mixture was stirred to form precipitates. The dispersion of the precipitates was further dispersed in an ultrasonic homogenizer at the maximum power for 10 minutes to obtain a dispersion of the slip agent.

The following solution was then prepared, and was coated on the protective backing layer in the amount of 10 ml/m$^2$. The coated solution was dried at 110° C. for 3 minutes to form a surface backing layer B.

The above-mentioned procedures were conducted in an authomatic coating machine using a conveying case and a conveying roller at 110° C.

| Surface backing layer B | |
|---|---|
| Acetone | 600 ml |
| Cyclohexanone | 360 ml |
| Dispersion of the slip agent | 40 g |

Formation of surface backing layer C

A surface backing layer C was formed on the protective backing layer in the same manner as in the formation of the layer B, except that 4 g of diacetyl cellulose was added to the coating solution.

Formation of photographic emulsion layers

Silver halide emulsion layers for color reversal photographic materials were coated on the undercoating layer to obtain samples.

The samples were cut into a photographic film of 24 frames having the width of 35 mm according to the conventional 135 format.

The samples were then treated as follows.

| Color reversal development process | | |
|---|---|---|
| | Time | Temperature |
| First development | 6 minutes | 38° C. |
| Washing | 2 minutes | 38° C. |
| Reversal process | 2 minutes | 38° C. |
| Color development | 6 minutes | 38° C. |
| Adjustment | 2 minutes | 38° C. |
| Bleaching | 6 minutes | 38° C. |
| Fixing | 4 minutes | 38° C. |
| Washing | 4 minutes | 38° C. |
| Stabilizing | 1 minute | 25° C. |

The obtained samples were evaluated about the items (1) to (4) in the same manner as in Example 1.

(1) Kinetic friction coefficient (2) Resistance to scratch (3) Coated surface (4) Repellent patterns The results are set forth in Table 2. In Table 2, SBL means the above-mentioned process for the formation of the surface backing layer A, B or C.

TABLE 2

| No. | Support | Slip agent | SBL | Additive | (1) (B) | (1) (A) | (2) (B) | (2) (A) | (3) | (4) |
|---|---|---|---|---|---|---|---|---|---|---|
| 2-1 | PET | None | None | None | 0.45 | 0.43 | 15 | 13 | A | A |
| 2-2 | PET | I-4 | A | None | 0.11 | 0.12 | 58 | 57 | C | B |
| 2-3 | PET | II-8 | A | None | 0.12 | 0.14 | 58 | 56 | C | B |
| 2-4 | PET | I-1 | B | III-4 | 0.12 | 0.13 | 60 | 56 | B | A |
| 2-5 | PET | I-4 | B | III-2 | 0.12 | 0.13 | 57 | 55 | B | A |
| 2-6 | PET | I-4 | C | III-2 | 0.11 | 0.12 | 55 | 56 | A | A |
| 2-7 | PET | II-1 | B | III-5 | 0.11 | 0.12 | 56 | 55 | B | A |
| 2-8 | PET | II-1 | C | III-5 | 0.11 | 0.12 | 56 | 57 | A | A |
| 2-9 | PET | II-8 | B | III-1 | 0.12 | 0.13 | 58 | 54 | B | A |
| 2-10 | PEN | I-4 | B | III-2 | 0.10 | 0.11 | 58 | 56 | B | A |
| 2-11 | PEN* | I-4 | B | III-2 | 0.11 | 0.12 | 57 | 57 | B | A |
| 2-12 | PET | C-1 | A | None | 0.11 | 0.13 | 60 | 58 | C | C |
| 2-13 | PET | C-1 | B | III-2 | 0.12 | 0.12 | 57 | 56 | B | C |
| 2-14 | PET | C-2 | B | III-4 | 0.11 | 0.12 | 59 | 58 | B | C |

(Remark)
(B) of (1) or (2): Value measured before development
(A) of (1) or (2): Value measured after development TABLE 2-continued

| No. | Support | Slip agent | SBL | Additive | (1) (B) | (1) (A) | (2) (B) | (2) (A) | (3) | (4) |
|---|---|---|---|---|---|---|---|---|---|---|

PEN*: Curled and heated PEN film
Ratio of I-1 to III-4: 4/6
Ratio of I-4 to III-2: 3/7
Ratio of II-1 to III-5: 2/8
Ratio of II-8 to III-1: 4/6
Ratio of I-4 to III-2: 3/7
Ratio of C-1 to III-2: 4/6
Ratio of C-1 to III-4: 5/5

The comparative slip agents (C-1) and (C-2) are shown in Example 1.

Further, the surface treatment of the sample No. 2-4, 2-10 or 2-11 was changed form the ultraviolet irradiation (a) to the corona discharge treatment (b) or the glow discharge treatment (c), which are shown below. Furthermore, the sample No. 2-4, 2-10 or 2-11 was prepared again in the same manner, except that the surface treatment was not conducted and the undercoating layer (a) was coated on the support.

The adhesion between the support and the backing layer or the emulsion layer was measured about the above-prepared samples. As a result, the adhesion was improved by the ultraviolet irradiation (a), the corona discharge treatment (b) or the glow discharge treatment (c). Particularly, the adhesion of the polyethylene naphthalate (PEN) film support was improved by the ultraviolet irradiation (a) or the glow discharge treatment (c).

(b) Corona discharge treatment

The two surfaces of the supports were subjected to a corona discharge treatment in a solid state corona treating machine (6KVA model, Pillar Co., Ltd.) under the condition of 0.375 KV·A·minute per 1 $m^2$. The supports having the width of 30 cm were treated at the rate of 20 m per minute. The wavelength of the charge was 9.6 kHz. The gap clearance between the electrode and the dielectric roll was 1.6

The following solution for the undercoating layer (b) was coated on the treated support, and dried.

| Undercoating layer (b) | |
|---|---|
| Gelatin | 3 g |
| Distilled water | 250 cc |
| Sodium (α-sulfo-di-2-ethylhexylsuccinate | 0.05 g |
| Formaldehyde | 0.02 g |

(c) Glow discharge treatment

The two surfaces of the supports were subjected to a glow discharge treatment under the reduced pressure of 0.2 mmHg. The power was 2,500 W.

The following solution for the undercoating layer (c) was coated on the treated support in the amount of 10 ml/$m^2$. The solution was dried at 115° C. for 6 minutes.

| Undercoating layer (c) | Weight part |
|---|---|
| Gelatin | 1.0 |
| Salicylic acid | 0.3 |
| Resorcinol | 1.0 |
| The following ammonium compound | 0.05 |
| Polyoxyethylene nonylphenylether (polymerization degree: 10) | 0.1 |
| Water | 2.2 |
| Methanol | 95.35 |
| Ammonium compound | |

-continued

| Undercoating layer (c) | Weight part |
|---|---|

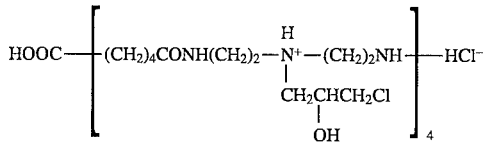

EXAMPLE 3

The samples Nos. 1-3, 2-5, 2-10 and 2-11 prepared in Examples 1 & 2 were evaluated in a patrone according to the conventional 135 format. The frame numbers are set forth in Table 3.

The patrone was placed in a sealed case. The case was heated at 80° C. for 2 hours. Thus, the film was curled.

The case was left at 25° C. in a room over one night. The curled film was then developed in an authomatic developing machine (Minilabo FP-560B, Fuji Photo Film Co., Ltd.). As a result, no problem was observed on samples (grade A). Some samples were slightly curled at the end (grade B). The other samples were bent at the end to cause a trouble while moving the samples in the developing machine (grade C).

The results are set forth in Table 3.

TABLE 3

| Sample No. | Support Polymer | Support Thickness | Frames | Grade |
|---|---|---|---|---|
| 1-3 | TAC | 120 μm | 36 | B |
| 1-3 | TAC | 120 μm | 48 | C |
| 2-5 | PET | 90 μm | 36 | B |
| 2-5 | PET | 90 μm | 48 | C |
| 2-5 | PET | 90 μm | 60 | C |
| 2-10 | PEN | 90 μm | 36 | B |
| 2-10 | PEN | 90 μm | 48 | C |
| 2-10 | PEN | 90 μm | 60 | C |
| 2-11 | PEN* | 90 μm | 36 | A |
| 2-11 | PEN* | 90 μm | 48 | A |
| 2-11 | PEN* | 90 μm | 60 | A |

EXAMPLE 4

Preparation of film support

Polyethylene terephthalate (PET) films and polyethylene naphthalate (PEN) films were prepared in the same manner as in Example 2.

The films were subjected to the ultraviolet irradiation (a), the corona discharge treatment (b) or the glow discharge treatment (c) in the same manner as in Example 2. The undercoating layers (a), (b) and (c) were also coated on the films in the same manner as in Example 2.

Further, the following solution for the undercoating layer (x) was coated on the PET film that is not subjected to the surface treatment. The coated film was stretched again while drying the layer. The thickness of the stretched film was 90 μm.

| Undercoating layer (x) | |
|---|---|
| Aqueous dispersion of vinylidene-acrylonitrile-itaconic acid copolymer (molar ratio is 92/5/3) | 1.5 g/m$^3$ |
| Sodium dodecylbenzenesulfonate | 2 g/m$^2$ |
| Silica particles (average particle size: 0.3 μm) | 20 mg/m$^2$ |
| Polystyrene particles (average particle size: 1.0 μm) | 2 mg/m$^2$ |
| 2-Hydroxy-4,6-dichloro-1,3,5-triazine | 35 mg/m$^2$ |
| Trimethylolpropane triaziridine | 10 mg/m$^2$ |

(d) Flame treatment

Some films were subjected to a flame treatment.

The distance between the film and the internal flame was 3 cm. A mixture of propane gas and the air (volume ratio: 1/18) was used. The treatment was conducted at 5 Kcal/m$^2$. A hollow roll was used as the backup roll for the film. Cooling water passed through the hole of the roll to keep the temperature at 30° C.

Formation of adhesive layer

One of the following coating solutions (11) to (13) and (21) to (24) was coated on the back face (on which the undercoating layer was not provided) of the support using a wire bar. The solution was dried at 115° C. to remove the solvent. The layer was irradiated with ultraviolet ray for 5 seconds using a high pressure mercury lamp at 120 W/cm in an atmosphere of nitrogen gas.

| | Weight part |
|---|---|
| Adhesive layer (11) | |
| Urethane acrylate (Satomer 9505, Somar) | 4.0 |
| Pentaerythritol triacrylate | 5.0 |
| Isocyanate compound VII-2 | 1.0 |
| 1-Hydroxycyclohexyl phenyl ketone | 0.45 |
| Acetone | 90 |
| Adhesive layer (12) | |
| Urethane acrylate (Alonix M1200, Toagosei Chemical Industry Co., Ltd.) | 6.0 |
| Pentaerylthritol triacrylate | 3.0 |
| Isocyanate compound VII-2 | 1.0 |
| 1-Hydroxycyclohexyl phenyl ketone | 0.45 |
| Acetone | 90 |
| Adhesive layer (13) | |
| Urethane acrylate (Satomer 9505, SOmar) | 6.5 |
| Pentafunctional acrylate (Alonix M400, Toagosei Chemical Industry Co., Ltd.) | 1.5 |
| Isocyanate compound VII-1 | 2.0 |
| 1-Hydroxycyclohexyl phenyl ketone | 0.45 |
| Acetone | 90 |
| Adhesive layer (21) | |
| Urethane acrylate (Satomer 9505, Somar) | 5.0 |
| Pentaerylthritol triacrylate | 5.0 |
| 1-Hydroxycyclohexyl phenyl ketone | 0.45 |
| Acetone | 90 |
| Adhesive layer (22) | |
| Urethane acrylate (Satomer 9505, SOmar) | 4.5 |
| Pentaerythritol triacrylate | 4.5 |
| The following epoxy compound | 1.0 |
| 1-Hydroxycyclohexyl phenyl ketone | 0.45 |
| Acetone | 90 |
| Epoxy compound | |

-continued

| | Weight part |
|---|---|

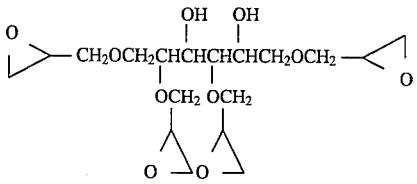

| Adhesive layer (23) | |
|---|---|
| Urethane acrylate (Satomer 9505, Somar) | 4.5 |
| Tripropylene glycol diacrylate | 4.5 |
| Isocyanate compound (VII-2) | 1.0 |
| 1-Hydroxycyclohexyl phenyl ketone | 0.45 |
| Acetone | 90 |
| Adhesive layer (24) | |
| Pentaerylthritol triacrylate | 9.0 |
| Isocyanate | 1.0 |
| 1-Hydroxycyclohexyl phenyl ketone | 0.45 |
| Acetone | 90 |

Formation of surface backing layer In 5.0 g of xylene (solvent), 1.8 g of the slip agent (I-2) was dissolved at 90° C.

The solution was added to 50.0 g of propylene glycol monomethylether. The mixture was dispersed in an ultrasonic homogenizer to obtain a dispersion of the slip agent.

To the dispersion, 700 g of xylene and 200 g of cyclohexane were added. The obtained coating solution was coated on the adhesive layer of the samples (except the sample No. 1-B set forth in Table 4) and dried.

Formation of emulsion layers

Photographic emulsion layers were provided on the reverse face (on which the backing layers were not coated) of the support to obtain samples.

Evaluation of samples

The samples were cut into a photographic film of 24 frames having the width of 35 mm according to the conventional 135 format.

The samples were then evaluated about the items (1) and (2) in the same manner as in Example 1.

(1) Kinetic friction coefficient (2) Resistance to scratch (caused by needle)

Further, the samples were evaluated about the following items (6) to (8).

(6) Resistance to scratch (caused by brush)

The samples were conditioned at 25° C. and the relative humidity of 60% for 2 hours. A nylon brush was applied to the back surface of the samples. The samples were scratched with the brush under the charge of 20 g/cm$^2$ at the rate of 60 cm per minute.

The back surface was observed to count the number of the scratch.

(7) Dry adhesion

The back surface of the film was crosswise cut with a razor to form 6 linear cuts (distance: 5 mm) at each of the length and breadth directions. Thus, 25 square cuts were formed. An adhesive tape was applied to the cut surface. The tape was immediately removed at the direction of 180°. The separation of the backing layer was observed. The adhesion of the backing layer was evaluated as the following grades A to E.

A: The backing layer was not separated.

B: Not more than 5% of the layer was separated.

C: Not more than 10% of the layer was separated.

D: Not more than 40% of the layer was separated.

E: More than 40% of the layer was separated.

(8) Wet adhesion

The back surface was scratched with a pencil in a developing solution to form a cross scratch. The scratch was further rubbed in the solution. The width of the separation along the scratch was measured. The adhesion of the backing layer was evaluated as the following grades A to D.

A: The backing layer was not separated.

B: Width of the separation was less than 2 mm.

C: Width of the separation was less than 5 mm.

D: Width of the separation was more than 5 mm.

The results are set forth in Table 4

TABLE 4

| Samp. No. | Support | surface | Adhesive | Slip (1) | Scratch (2) | Scratch (6) | Adhesion (7) | Adhesion (8) |
|---|---|---|---|---|---|---|---|---|
| 1-A | PET | (a) | (11) | 0.10 | 120 | 0 | A | A |
| 1-B | PET | (x) | (11) | 0.35 | 70 | 1 | B | A |
| 1-C | PEN | (a) | (11) | 0.10 | 110 | 0 | B | A |
| 1-D | PEN | (b) | (12) | 0.10 | 110 | 0 | B | A |
| 1-E | PEN | (c) | (11) | 0.10 | 110 | 0 | A | A |
| 1-F | PEN | (d) | (12) | 0.10 | 110 | 0 | B | A |
| 1-G | PEN | (c) | (13) | 0.10 | 120 | 0 | A | A |
| 1-H | PEN | (c) | (21) | 0.10 | 90 | 0 | E | C |
| 1-I | PEN | (c) | (22) | 0.10 | 100 | 0 | D | B |
| 1-J | PEN | (a) | (23) | 0.10 | 30 | 5 | B | A |
| 1-K | PEN | (b) | (24) | 0.10 | 20 | 0 | B | A |

EXAMPLE 5

Preparation of film support

Polyethylene terephthalate (PET) films and polyethylene naphthalate (PEN) films were prepared in the same manner as in Example 2.

The PEN film (Tg: 119° C.) was wound around a core (diameter: 30 cm) while the front face (on which photographic layer would be formed) outside. The wound film was subjected to a preheat treatment at 150° C. for 5 minutes. The film was then subjected to a post heat treatment while lowering the temperature from 129° C. to 79° C. at the rate of −1° C. per minute. However, the sample No. 2-B set forth in Table 5 was not subjected to the thermal treatments.

The films were subjected to the glow discharge treatment (c) in the same manner as in Example 2. The undercoating layer (c) was also coated on the films in the same manner as in Example 2.

Formation of antistatic backing layer

An antistatic backing layer was formed on the back face (on which the undercoating layer was not provided) of the support in the same manner as in Example 2. However, the antistatic backing layer was not formed on the sample No. 2-D set forth in Table 5.

Formation of adhesive layer

An adhesive layer (11), (12), (13) or (21) was formed on the antistatic backing layer in the same manner as in Example 4.

Formation of surface backing layer

A surface backing layer was formed on the adhesive layer in the same manner as in Example 4.

Formation of photographic emulsion layers

Photographic emulsion layers for color photographic materials were provided on the reverse face (on which the backing layers were not coated) of the support to obtain samples. The layered structure of the samples is shown below.

15. Second protective layer
14. First protective layer
13. Blue sensitive emulsion layer of high sensitivity
12. Blue sensitive emulsion layer of low sensitivity
11. Yellow filter layer
10. Green sensitive emulsion layer of high sensitivity
9. Green sensitive emulsion layer of middle sensitivity
8. Green sensitive emulsion layer of low sensitivity
7. Intermediate layer
6. Red sensitive emulsion layer of high sensitivity
5. Red sensitive emulsion layer of middle sensitivity
4. Red sensitive emulsion layer of low sensitivity
3. Intermediate layer
2. Antihalation layer
1. Undercoating layer
0. Support
B1. Antistatic backing layer
B2. Adhesive layer
B3. Surface backing layer EvaluatiOn of samples The samples were cut into a photographic film of 24 frames having the width of 35 mm according to the conventional 135 format. The film was wound in a patrone.

The patrone was placed in a sealed case. The case was heated at 80° C. for 2 hours. Thus, the film was curled.

The samples were then developed in the same manner as in Example 1.

The samples were then evaluated with respect to (2) resistance to scratch caused by needle, (6) resistance to scratch caused by brush, (7) wet adhesion and (8) dry adhesion in the same manner as in Example 4. Further, the samples were evaluated with respect to the following items (9) and (10).

(9) Resistance to scratch (observed in print)

The films were wound in a patrone according to the conventional 135 format. A photograph was taken using the films in a camera. The films were developed and printed according to a conventional process. The number of scratch in the print was counted.

(10) Resistance to scratch (observed in scanner)

The films were treated in the same manner as in the item (10). The obtained print was enlarged as the L print size, and scanned. The number of scratch observed in the scanner was counted.

The results are set forth in Table 5

TABLE 5

| No. | Support | Heat | ABL | AL | Scratch resistance (2) | Scratch resistance (6) | Scratch resistance (9) | Scratch resistance (10) | Adhesion (7) | Adhesion (8) |
|---|---|---|---|---|---|---|---|---|---|---|
| 2-A | PET | − | + | (11) | 110 | 0 | 7 | 10 | A | A |
| 2-B | PEN | + | + | (11) | 100 | 0 | 5 | 7 | A | A |
| 2-C | PEN | + | + | (11) | 100 | 0 | 1 | 2 | A | A |
| 2-D | PEN | + | − | (11) | 110 | 0 | 2 | 3 | A | A |
| 2-E | PEN | + | + | (12) | 95 | 0 | 1 | 1 | A | A |
| 2-F | PEN | + | + | (13) | 100 | 0 | 1 | 2 | A | A |
| 2-G | PEN | + | + | (21) | 90 | 2 | 2 | 10 | E | D |

(Remark)
Heat: Support subjected to heat treatments (+) or not (−)
ABL: Antistatic backing layer provided (+) or not (−)
AHL: Adhesive layer Further, other samples were prepared in the same manner as is described above, except that photographic emulsion layers for a color reversal film were coated on the support. The samples were evaluated in the same manner as is described above. As a result, the similar values were evaluated.

We claim:

1. A silver halide photographic material comprising a silver halide emulsion layer provided on one side of a support and a surface backing layer provided on the opposite side of said support, wherein the surface backing layer contains an aliphatic hydrocarbon compound represented by the formula (I):

$$C_{n1}H_{m1}—X^1—C_{n2}H_{m2} \quad (I)$$

in which $X^1$ is a divalent linking group selected from the group consisting of —CO—, —O—, —S—, —$NR^1$—, —SO—, —$SO_2$— and a combination thereof; $R^1$ is hydrogen or an aliphatic group having 1 to 8 carbon atoms; each of n1 and n2 independently is an integer of 4 to 100; each of m1 and m2 independently is an integer of 9 to 201; n1+n2 is an integer of 25 to 120; at least one hydrogen atom of the groups $C_{n1}H_{m1}$— and —$C_{n2}H_{m2}$ is substituted with a polar group selected from the group consisting of —OH, —$COOM^1$, —$NH_2$, —$N^+R^2R^3R^4A^-$, —$CONH_2$ and —$SO_3M^2$; each of $R^2$, $R^3$, and $R^4$ independently is hydrogen or an aliphatic group having 1 to 8 carbon atoms; each of $M^1$ and $M^2$ is a cation; and A is an anion.

2. The silver halide photographic material as claimed in claim 1, wherein each of n1 and n2 independently is an integer of 10 to 70; and each of m1 and m2 independently is an integer of 20 to 141.

3. The silver halide photographic material as claimed in claim 1, wherein n1+n2 is an integer of 30 to 100.

4. The silver halide photographic material as claimed in claim 1, wherein the surface backing layer contains the aliphatic hydrocarbon compound in an amount of 0.001 to 0.1 $g/m^2$.

5. The silver halide photographic material as claimed in claim 1, wherein the aliphatic hydrocarbon compound is in the form of particles, which are dispersed in a binder of the surface backing layer.

6. The silver halide photographic material as claimed in claim 1, wherein the surface backing layer further contains a nonionic surface active agent or an anionic surface active agent.

7. The silver halide photographic material as claimed in claim 1, wherein the photographic material further has an antistatic backing layer between the support and the surface backing layer.

8. The silver halide photographic material as claimed in claim 1, wherein the photographic material further has a protective backing layer containing a matting agent between the support and the surface backing layer.

9. The silver halide photographic material as claimed in claim 1, wherein the photographic material further has an adhesive layer between the support and the surface backing layer.

10. The silver halide photographic material as claimed in claim 9, wherein the adhesive layer is made from a radiation setting resin and an isocyanate compound.

11. A silver halide photographic material comprising a silver halide emulsion layer provided on one side of a support and a surface backing layer provided on the opposite side of said support, wherein the surface backing layer contains an aliphatic hydrocarbon compound represented by the formula (II):

$$C_{n3}H_{m3}—X^2—C_{n4}H_{m4}—X^3—C_{n5}H_{m5} \quad (II)$$

in which each of $X^2$ and $X^3$ independently is a divalent linking group selected from the group consisting of —CO—, —O—, —S—, —$NR^1$—, —SO—, —$SO_2$— and a combination thereof; $R^1$ is hydrogen or an aliphatic group having 1 to 8 carbon atoms; each of n3 and n5 independently is an integer of 4 to 100; each of m3 and m5 independently is an integer of 9 to 201; n4 is an integer of 3 to 100; m4 is an integer of 6 to 200; n3+n4+n5 is an integer of 30 to 150; at least one hydrogen atom of the groups $C_{n3}H_{m3}$—, —$C_{n4}H_{m4}$— and —$C_{n5}H_{m5}$ in the formula is substituted with a polar group selected from the group consisting of —OH, —$COOM^1$, —$NH_2$, —$N^+R^2R^3R^4A^-$, —$CONH_2$ and —$SO_3M^2$; each of $R^2$, $R^3$, and $R^4$ independently is hydrogen or an aliphatic group having 1 to 8 carbon atoms; each of $M^1$ and $M^2$ is a cation; and A is an anion.

12. The silver halide photographic material as claimed in claim 11, wherein each of n3 and n5 independently is an integer of 10 to 70; each of m3 and m5 independently is an integer of 20 to 141; n4 is an integer of 5 to 50; and m4 is an integer of 10 to 100.

13. The silver halide photographic material as claimed in claim 11, wherein n3+n4+n5 is an integer of 40 to 130.

14. The silver halide photographic material as claimed in claim 11, wherein the surface backing layer contains the aliphatic hydrocarbon compound in an amount of 0.001 to 0.1 $g/m^2$.

15. The silver halide photographic material as claimed in claim 11, wherein the aliphatic hydrocarbon compound is in the form of particles, which are dispersed in a binder of the surface backing layer.

16. The silver halide photographic material as claimed in claim 11, wherein the surface backing layer further contains a nonionic surface active agent or an anionic surface active agent.

17. The silver halide photographic material as claimed in claim 11, wherein the photographic material further has an antistatic backing layer between the support and the surface backing layer.

18. The silver halide photographic material as claimed in claim 11, wherein the photographic material further has a protective backing layer containing a matting agent between the support and the surface backing layer.

19. The silver halide photographic material as claimed in claim 11, wherein the photographic material further has an adhesive layer between the support and the surface backing layer.

20. The silver halide photographic material as claimed in claim 19, wherein the adhesive layer is made from a radiation setting resin and an isocyanate compound.

21. The silver halide photographic material as claimed in claim 1, wherein the polar group is selected from the group consisting of —OH, —$COOM^1$, —$NH_2$, —$CONH_2$ and —$SO_3M^2$.

22. The silver halide photographic material as claimed in claim 11, wherein the polar group is selected from the group consisting of —OH, —$COOM^1$, —$NH_2$, —$CONH_2$ and —$SO_3M^2$.

* * * * *